US010861287B2

(12) United States Patent
Nakamura

(10) Patent No.: US 10,861,287 B2
(45) **Date of Patent: *Dec. 8, 2020**

(54) GAMING MACHINE, CONTROL METHOD FOR MACHINE, AND PROGRAM FOR GAMING MACHINE WITH SYMBOL ANIMATION ACROSS TRIGGERED GAMES

(71) Applicant: Konami Gaming, Inc., Las Vegas, NV (US)

(72) Inventor: Daisuke Nakamura, Zama (JP)

(73) Assignee: Konami Gaming, Inc., Las Vegas, NV (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/295,941

(22) Filed: Mar. 7, 2019

(65) Prior Publication Data

US 2019/0206194 A1 Jul. 4, 2019

Related U.S. Application Data

(63) Continuation of application No. 15/179,782, filed on Jun. 10, 2016, now Pat. No. 10,269,217.

(51) Int. Cl.

| | |
|---|---|
| ***A63F 9/24*** | (2006.01) |
| ***G07F 17/32*** | (2006.01) |
| ***G07F 17/34*** | (2006.01) |

(52) U.S. Cl.

CPC ..... *G07F 17/3267* (2013.01); *G07F 17/3211* (2013.01); *G07F 17/3213* (2013.01); *G07F 17/34* (2013.01)

(58) Field of Classification Search

CPC ..... G07F 17/3267; G07F 17/3213; G07F 17/3211; G07F 17/3265; G07F 17/326; G07F 17/3262; G07F 17/34

See application file for complete search history.

(56) References Cited

U.S. PATENT DOCUMENTS

| | | | |
|---|---|---|---|
| 6,652,378 | B2 | 11/2003 | Cannon et al. |
| 2004/0242312 | A1 | 12/2004 | Gomez et al. |
| 2005/0059476 | A1 | 3/2005 | Vancura |

(Continued)

FOREIGN PATENT DOCUMENTS

| | | | |
|---|---|---|---|
| EP | 1418553 | A2 | 5/2004 |

OTHER PUBLICATIONS

Patent Examination Report No. 1 (AU Patent Application No. 2015230776); dated Oct. 28, 2015; 2 pages.

(Continued)

*Primary Examiner* — Justin L Myhr

(74) *Attorney, Agent, or Firm* — Howard & Howard Attorneys PLLC

(57) ABSTRACT

A gaming machine that provides an operation unit, a display unit and a control unit. The operation unit is configured to receive an operation of the player. The display unit is operably coupled to the operation unit and is configured to display a first feature symbol display area, a second feature symbol display area and a third feature display area. Each display area includes a plurality of cells arranged in a grid. The control unit is operably coupled to the operation unit and the display unit and is configured to provide a primary game and a feature game. The three display areas are used in the feature game in turn. Any appearance of a predetermined symbol in one of the display areas is copied in to the next display area(s) in sequence.

24 Claims, 28 Drawing Sheets

(56) References Cited

U.S. PATENT DOCUMENTS

| | | | |
|---|---|---|---|
| 2006/0025192 | A1 | 2/2006 | Walker et al. |
| 2007/0066389 | A1 | 3/2007 | Kojima |
| 2009/0239631 | A1 | 9/2009 | Aoki et al. |
| 2011/0105218 | A1 | 5/2011 | Anderson et al. |
| 2012/0202592 | A1 | 8/2012 | Sprinkle |

OTHER PUBLICATIONS

Patent Examination Report No. 2 (AU Patent Application No. 2015230776) dated Feb. 3, 2016; 4 pages.

GAMING MACHINE, CONTROL METHOD FOR MACHINE, AND PROGRAM FOR GAMING MACHINE WITH SYMBOL ANIMATION ACROSS TRIGGERED GAMES

CROSS REFERENCE TO RELATED APPLICATION

This application is a continuation of U.S. patent application Ser. No. 15/179,782, filed Jun. 10, 2016, which claims priority to Australian Patent Application No. 2015230776, filed Sep. 24, 2015, the disclosures of which are hereby incorporated by reference in their entirety.

TECHNICAL FIELD

The present invention relates to a gaming machine, a control method for a gaming machine, and a program for a gaming machine.

BACKGROUND ART

A gaming machine represented by a slot machine is highly popular among casino customers as a device that provides gaming that is easy to enjoy, and recent statistics report that sales from gaming machines account for the majority of casino earnings. Initial slot machines were simple devices, wherein an inserted coin is received, a configured reel rotates and stops mechanically according to a handle operation, and a win or a loss is determined by a combination of symbols stopped on a single pay line. However, recent gaming machines, such as mechanical slot machines driven by a highly accurate physical reel via a computer controlled stepping motor, video slot machines that display a virtual reel on a display connected to a computer and various gaming machines that apply similar technology to other casino games are quickly advancing. For the manufacturers that develop these gaming machines, an important theme is to provide an attractive game that strongly attracts casino customers as players, and improves the functionality of the gaming machine.

SUMMARY OF INVENTION

In one aspect of the present invention, a gaming machine is provided. The gaming machine includes an operation unit, a display unit and a control unit. The operation unit is configured to receive an operation of the player. The display unit is operably coupled to the operation unit and is configured to display a first symbol display area, a second feature symbol display area and a third feature display area. Each display area include a plurality of cells arranged in a grid. The control unit is operably coupled to the operation unit and the display unit and is configured to provide a primary game and a feature game. The control unit, in response to player operation, provides an instance of the primary game to the player, detects a feature trigger condition and responsively initiates the feature game in response to detecting the feature trigger condition. The control unit, in response to initiation of the feature game, is further configured to:

randomly establish a first set of symbols associated with the first feature symbol display area, display the established first set of symbols for the first feature symbol display area, the set of symbols displayed in the cells of the first feature symbol display area, forming a first feature outcome, determine if a first instance of a predetermined symbol appears in the first feature outcome, randomly establish a second set of symbols associated with the second feature display area, copy the first instance of the predetermined symbol from the first feature symbol display area to the second feature symbol display area, display at least a part of the second set of symbols in the second feature display area, the at least a part of the set of second set of symbols and the first instance of the predetermined symbol forming a second feature outcome, determine if a second instance of the predetermined symbol appears in the second feature outcome, randomly establish a third set of symbols associated with the third feature display area, copy the first and second instances of the predetermined symbol from the second feature symbol display area to the third feature symbol display area, and display at least a part of the set of third set of symbols in the third feature display area, the at least a part of the set of third set of symbols and the first and second instances of the predetermined symbol forming a third feature outcome.

In another aspect of the invention, a control method for a gaming machine provides a game to a player. The gaming machine includes an operation unit, a display unit and a control unit. The operation unit is configured to receive an operation of the player. The display unit is operably coupled to the operation unit and is configured to display a first symbol display area, a second feature symbol display area and a third feature display area. Each display area includes a plurality of cells arranged in a grid. The control unit is operably coupled to the operation unit and the display unit and is configured to provide a primary game and a feature game. The control unit, in response to player operation, provides an instance of the primary game to the player, detects a feature trigger condition and responsively initiates the feature game in response to detecting the feature trigger condition. The control method, in response to initiation of the feature game, includes the steps of:

randomly establishing a first set of symbols associated with the first feature symbol display area;

displaying the established first set of symbols for the first feature symbol display area, the set of symbols displayed in the cells of the first feature symbol display area, forming a first feature outcome;

determining if a first instance of a predetermined symbol appears in the first feature outcome;

randomly establishing a second set of symbols associated with the second feature display area;

copying the first instance of the predetermined symbol from the first feature symbol display area to the second feature symbol display area, displaying at least a part of the second set of symbols in the second feature display area, the at least a part of the set of second set of symbols and the first instance of the predetermined symbol forming a second feature outcome, determining if a second instance of the predetermined symbol appears in the second feature outcome;

randomly establishing a third set of symbols associated with the third feature display area, copy the first and second instances of the predetermined symbol from the second feature symbol display area to the third feature symbol display area; and displaying at least a part of the set of third set of symbols in the third feature display area, the at least a part of the set of third set of symbols and the first and second instances of the predetermined symbol forming a third feature outcome.

In still another aspect of the present invention, a program for a gaming machine provides a game to a player. The gaming machine includes an operation unit, a display unit and a control unit. The operation unit is configured to receive an operation of the player. The display unit is operably coupled to the operation unit and is configured to display a first symbol display area, a second feature symbol display area and a third feature display area. Each display area includes a plurality of cells arranged in a grid. The control unit is operably coupled to the operation unit and the display unit and is configured to provide a primary game and a feature game. The program, in response to player operation, provides an instance of the primary game to the player, detects a feature trigger condition and responsively initiates the feature game in response to detecting the feature trigger condition. The program of the gaming machine performing the steps of:

randomly establishing a first set of symbols associated with the first feature symbol display area;

displaying the established first set of symbols for the first feature symbol display area, the set of symbols displayed in the cells of the first feature symbol display area, forming a first feature outcome;

determining if a first instance of a predetermined symbol appears in the first feature outcome;

randomly establishing a second set of symbols associated with the second feature display area;

copying the first instance of the predetermined symbol from the first feature symbol display area to the second feature symbol display area;

displaying at least a part of the set of second set of symbols in the second feature display area, the at least a part of the set of second set of symbols and the first instance of the predetermined symbol forming a second feature outcome;

determining if a second instance of the predetermined symbol appears in the second feature outcome;

randomly establishing a third set of symbols associated with the third feature display area, copy the first and second instances of the predetermined symbol from the second feature symbol display area to the third feature symbol display area; and displaying at least a part of the set of third set of symbols in the third feature display area, the at least a part of the set of third set of symbols and the first and second instances of the predetermined symbol forming a third feature outcome.

DETAILED DESCRIPTION OF EMBODIMENTS

A gaming machine, according to an embodiment of the present invention referencing the attached figures is described in detail below. Further, duplicated descriptions will be omitted for identical attached symbols in identical or corresponding parts in each figure.

With reference to the drawings, and in operation, the present invention is directed towards a gaming machine, a control method for a gaming machine and a program for a gaming machine that provides a game to a player. The game includes a primary game and a feature game. As will be discussed in further detail below, the feature game utilized first, second and third feature symbol display areas. The three display areas are used in the feature game in turn. Any appearance of a predetermined symbol in one of the display areas is copied into the next display area(s) in sequence.

Figure 1:
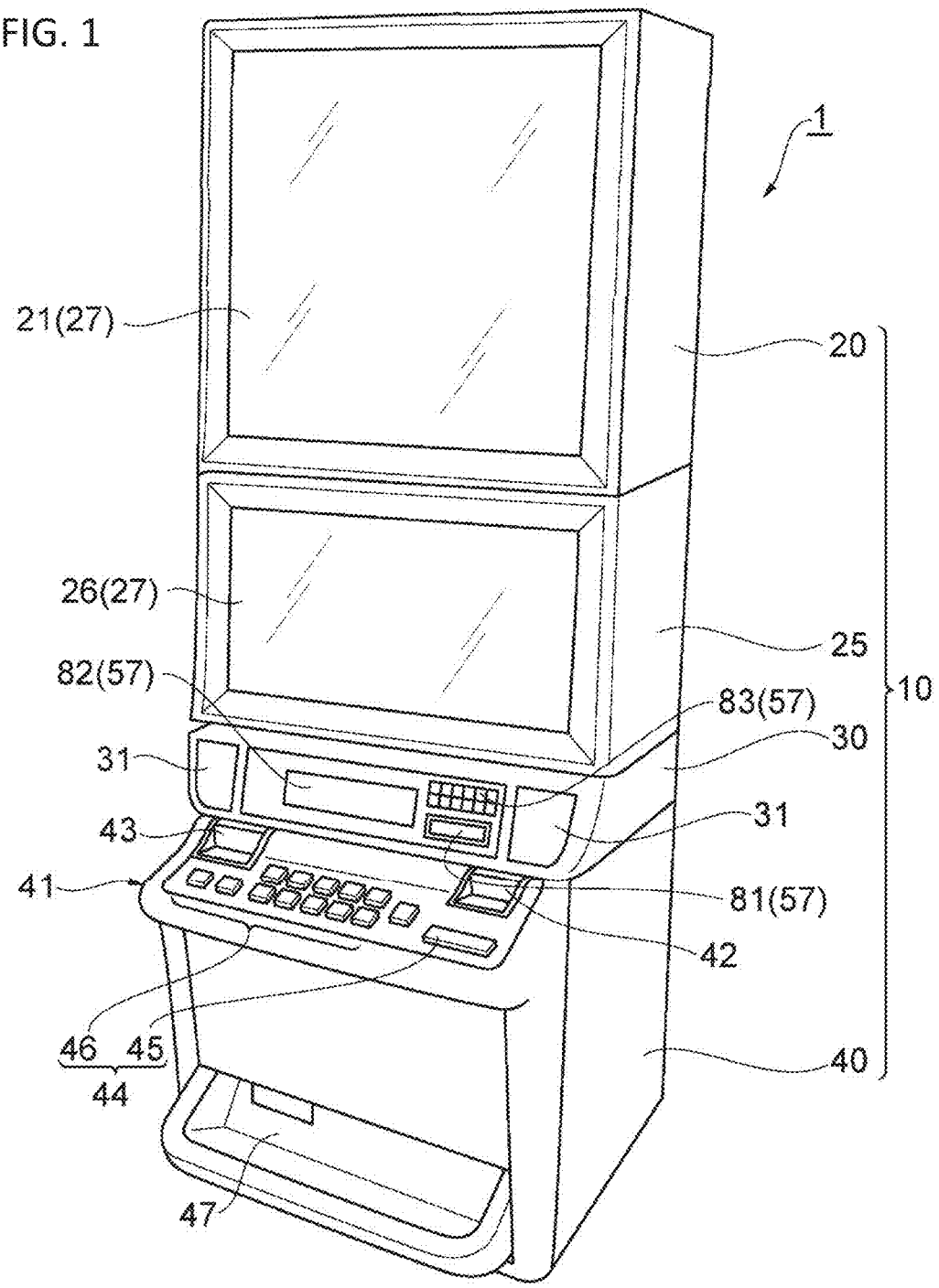
FIG. 1 is a perspective view of the gaming machine, according to the first embodiment.

The gaming machine, according to the present embodiment, receives a predetermined game value from the player, generates a game result and provides a payout to the player according to the game result. FIG. 1 is a perspective view of a gaming machine 1, according to the present embodiment. As shown in FIG. 1, this gaming machine 1 provides a first cabinet 20 providing an upper display 21, a second cabinet 25 providing a lower display 26, a third cabinet 30 that houses a player tracking unit 57 and a control panel 41, and has a housing 10 configured from a fourth cabinet 40 that houses a control unit 50 that controls each part. The control unit 50 also implements a random number generator (RNG) that is used during operation of the game. Each configuration is described below.

The first cabinet 20 is provided on the upper part of the housing 10, and the second cabinet 25 is provided below the first cabinet 20. The upper display 21 provided on the first cabinet 20 and the lower display 26 provided on the second cabinet 25, are flat panel display devices, such as both liquid crystal display devices and organic EL display devices and the like, and by controlling via each control unit 50, the game screen mentioned below functions as a display unit 27 provided to the player.

The third cabinet 30 is provided below the second cabinet 25. Speakers 31 are provided on the left and right of the front surface of the third cabinet 30, and by controlling via the control unit 50, sound is provided to the player. Further, the player tracking unit 57 is housed on the center of the front surface of the third cabinet 30. The player tracking unit 57 has a card unit 81 that recognizes a player identification card, a display 82 that presents data to the player, and a keypad 83 that receives input by the player. This type of player tracking unit 57, reads information recorded on the player identification card inserted by the player into the card reader 81, and displays the information and/or information acquired by communicating with the external system on the display 82, by cooperatively operating with the control unit 50 mentioned below, or an external system. Further, input from the player is received by the keypad 83, the display of the display 82 is changed according to the input and communication with the external system is carried out as necessary.

The fourth cabinet 40 is provided below the third cabinet 30. On the fourth cabinet 40, one part is made to project from a front side, and the control panel 41 is provided. On the control panel 41, a bill/ticket identification unit 42, the printer unit 43, and an operation unit 44 are provided.

The bill/ticket identification unit 42 is disposed on the control panel 41 in a state where the insertion opening that a bill or ticket is inserted into is exposed, an identification part that identifies a bill/ticket by various sensors on the inside of the insertion opening is provided, and a bill/ticket storage part is provided on the outgoing side of the identification part on the inside of the fourth cabinet 40. The bill/ticket identification unit 42, receives and identifies bills and tickets (including vouchers and coupons) that are the game value as a game executing value, and notifies the control unit 50 mentioned below.

The printer unit 43, is disposed on the control panel 41 in a state where the ticket output opening that a ticket is output from is exposed, a printing part that prints predetermined information on a printing paper on the inside of the ticket output opening is provided, and a housing part that houses the printing paper inside the paper inlet side of the printing part is provided. The printer unit 43, under the control of the control unit 50 mentioned below, prints information on paper and outputs a ticket according to credit payout processing from the gaming machine 1. The output ticket can use the payout credit as game play by being inserted into the bill/ticket identification unit of another gaming machine, or, can be exchanged for cash by a kiosk terminal inside of the casino or a casino cage.

The operation unit 44 receives the operation of the player. The operation unit 44 is a group of buttons that receives various instructions from the player on the gaming machine 1. The operation unit 44, for example, has a spin button 45 and group of setting buttons 46. The spin button 45 receives an instruction to start (start rotating the reel) the game listed below. The group of setting buttons 46 includes a group of bet buttons, a group of line-designation buttons, a max bet button and a payout button and the like. The group of bet buttons receive an instruction operation regarding the bet amount of credits (bet number) from the player. The group of line-designation buttons receive an instruction operation that designate a pay line (referred to as an effective line below) subjected to a line judgment below from the player. The max bet button receives an instruction operation regarding the bet of the maximum amount of credits that can be bet at one time from the player. The payout button receives an instruction operation instructing a credit payout accumulated in the gaming machine 1.

Further, on the inside of the fourth cabinet 40, a control board equipped with a central processing unit 51 (abbreviated as CPU below) that configures the control unit 50, an interface unit (or part) 52, a memory 53 and a storage 54 and the like is incorporated. The control board is configured so that communication is possible through the interface unit 52 and each of the components equipped on the first cabinet 20, the second cabinet 25, the third cabinet 30 and the fourth cabinet 40, controls the operation of each part by executing the program recorded in the memory 53 or the storage 54 of the CPU 51, and provides a game to the player.

Figure 2:
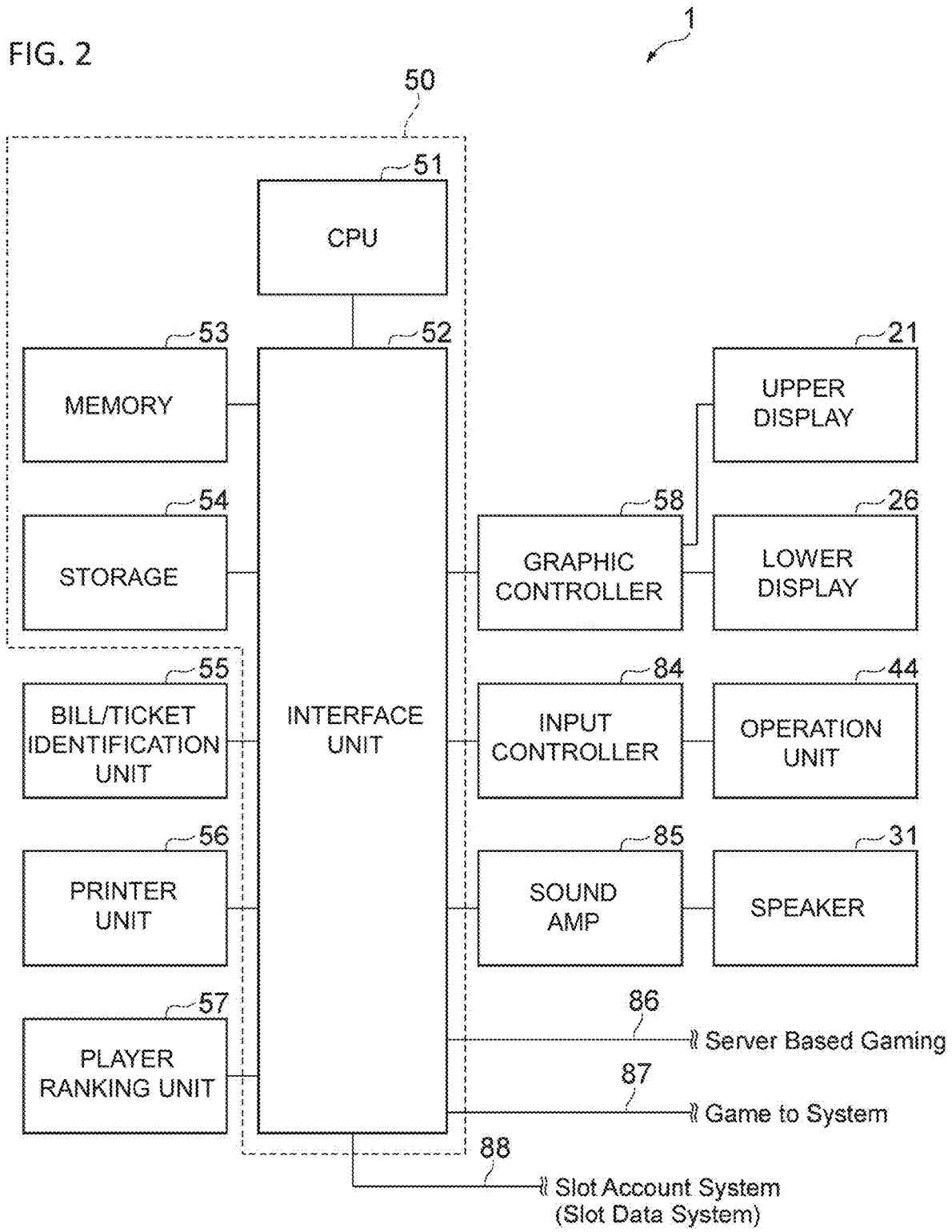
FIG. 2 is a functional block diagram of the gaming machine in FIG. 1.

FIG. 2 shows a functional block diagram of the gaming machine 1, according to the present embodiment. The gaming machine 1 provides the control unit 50. The control unit 50 is configured as the interface unit 52, including a chip set providing communication functions of the CPU 51, a memory bus connected to a CPU, various expanding buses, serial interfaces, USB interfaces, Ethernet (registered trademark) interfaces and the like, and a computer unit where the CPU 51 provides the addressable memory 53 and the storage 54 through the interface unit 52. The memory 53 can be configured to include RAM that is a volatile storage medium, ROM that is a non-volatile storage medium, and EEPROM that is a rewritable non-volatile storage medium. The storage 54 provides the control unit 50 as an external storage device function, can use reading devices such as a memory card that is a removable storage medium, and a magneto optical disk and the like, and can use hard disks.

On the interface unit 52, in addition to the CPU 51, the memory 53, and the storage 54, a bill/ticket identification unit 55, a printer unit 56, the player tracking unit 57, a graphic controller 58, an input controller 84, and a sound amp 85 are connected. That is, the control unit 50 is connected to the operation unit 44 through the input controller 84, and connected to the upper display 21 and/or the lower display 26 through the graphic controller 58. Further, when illumination that provides decorative lighting to the gaming machine 1 is provided, the illumination is controlled under the control of the control unit 50 on the interface unit 52, and an illumination controller that provides a decorative lighting effect may be connected.

The control unit 50, which includes memory 53 and storage 54, controls each part by executing a program stored in the memory 53 and the storage 54, and provides a game to the player. Here, for example, the memory 53 and storage 54 may be configured to store a program and data of an operating system and subsystem that provides the basic functions of the control unit 50 to the EEPROM of the memory 53, and stores a program and data of an application that provides a game to the storage 54. According to such a configuration, it can be easy to change or update a game by replacing the storage 54. Further, the control unit 50 may be a multiprocessor configuration that has a plurality of CPUs.

Each block connected to the control unit 50 is described below.

The bill/ticket identification unit 55 corresponds to the bill/ticket identification unit 42, receives bills or tickets in the insertion opening, and notifies the control unit 50 identifying information corresponding to the assortment of bills or the payout processing of credits. The bill/ticket identification unit 55 notifies the information to the control unit 50, and the control unit 50 increases the usable credit amount inside of the game, according to the notified content. The printer unit 56 corresponds to the printer unit 43, and under the control of the control unit 50 that receives an operation of the payout button of the group of setting buttons 46, information corresponding to the credit payout processing from the gaming machine 1 is printed and output on a printed ticket.

The player tracking unit 57 cooperatively operates with the control unit 50, and sends and receives information and the like of the player from the casino management system. The graphic controller 58 controls the upper display 21 and the lower display 26, under the control of the control unit 50, and displays a display image that includes various graphic data. The sound amp 85 drives the speakers 31 under the control of the control unit 50, and provides various sounds such as an announcement, sound effects, BGM and the like.

Further, the interface unit 52, has various communication interfaces for communicating with the exterior of the gaming machine 1, for example, can communicate with an external network by Ethernet 86, 87, and a serial output 88. In the present embodiment, one example shows when there is communication between a well-known server side gaming network (Server Based Gaming of FIG. 2), a G2S network (Game to System of FIG. 2), and a slot information system (Slot Data System of FIG. 2), respectively.

Figure 3A:
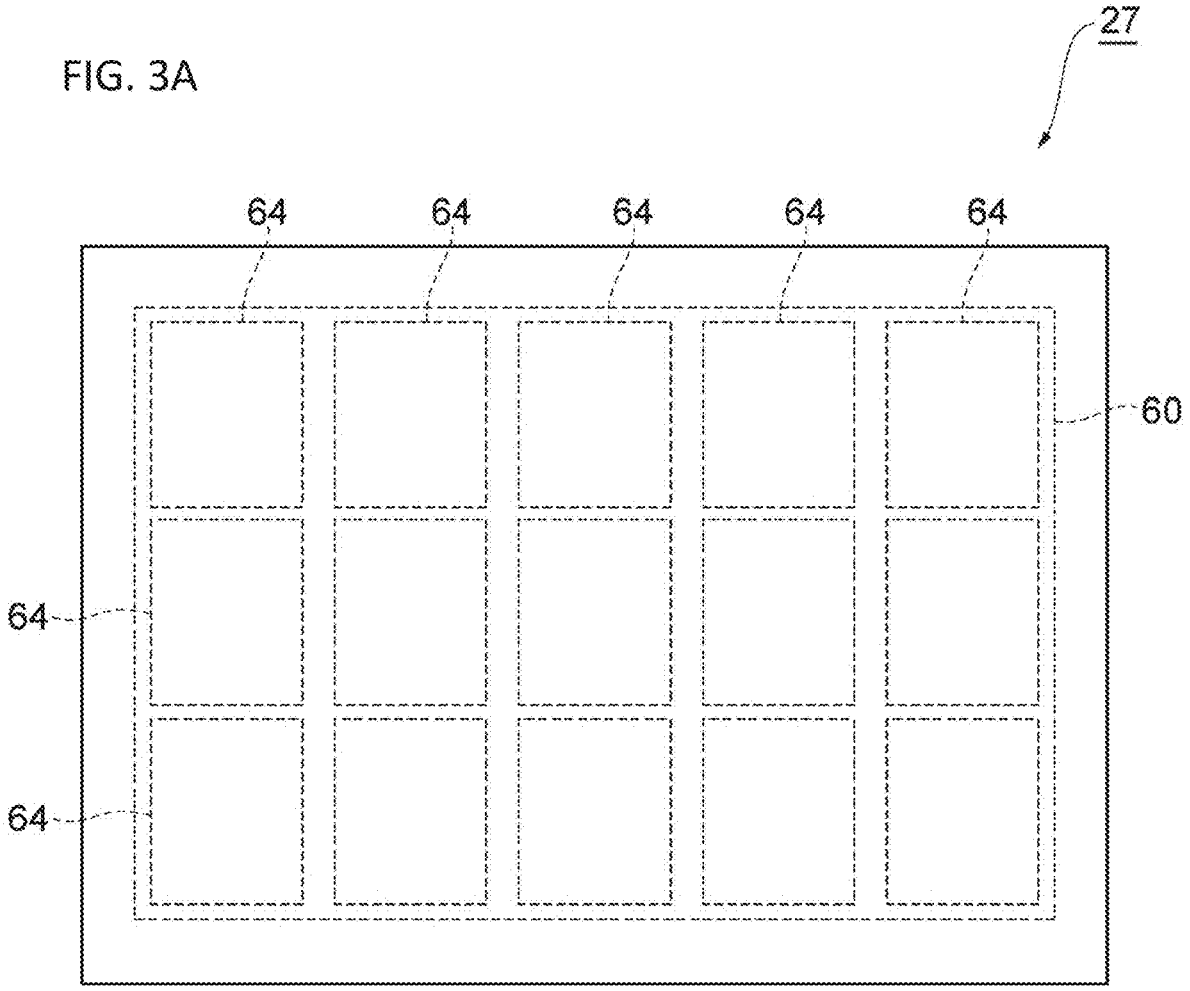
FIG. 3A is a first diagrammatic illustration of a primary determination or primary display area of the gaming machine in FIG. 1, according to an embodiment of the present invention.

FIG. 3A is a figure schematically showing a game screen provided by the gaming machine 1, according to the present embodiment. Such a game screen displays on the display unit 27 (the upper display 21 and/or the lower display 26) by the control unit 50 executing a predetermined program.

Figure 3B:
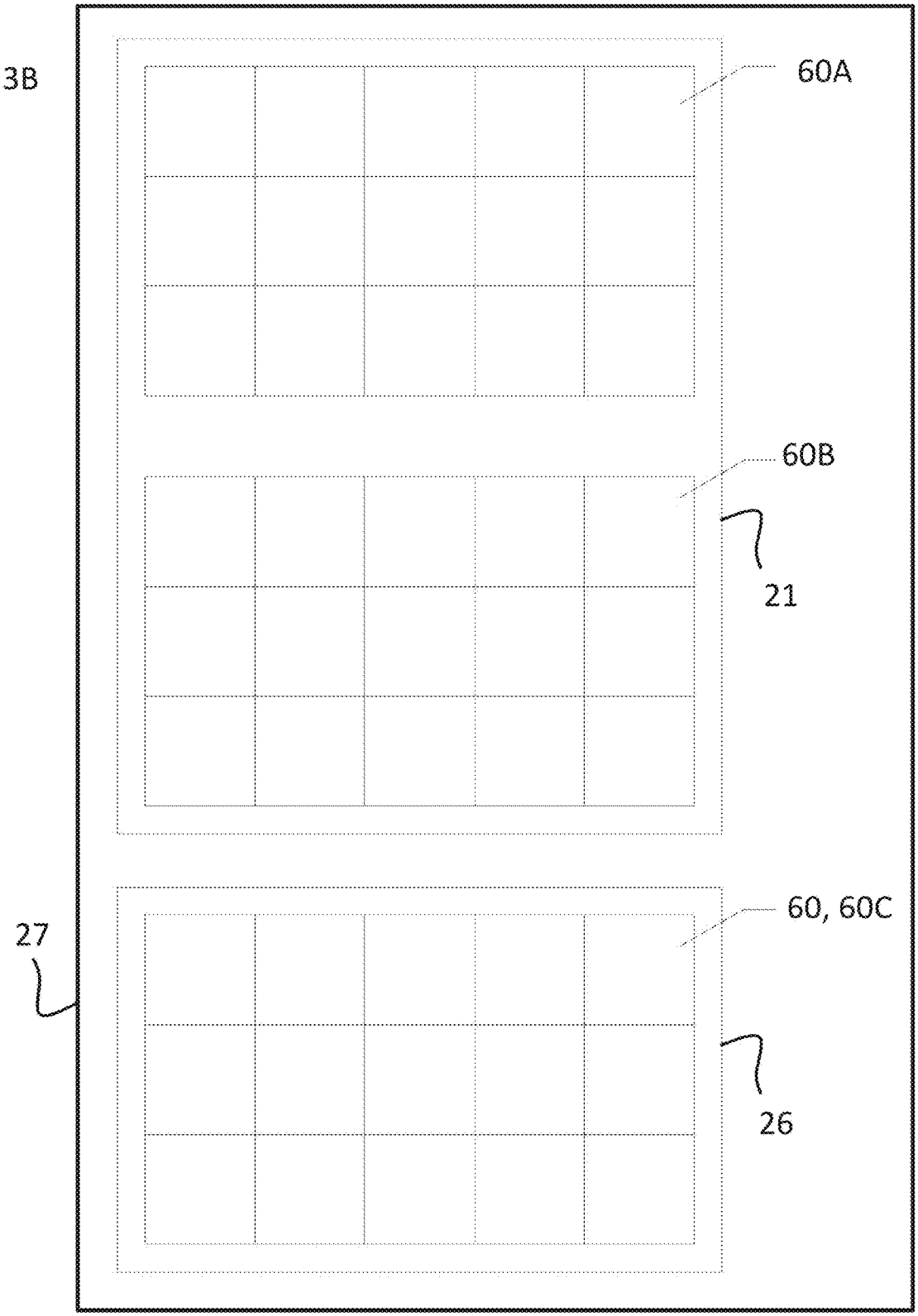
FIG. 3B is a diagrammatic illustration of the first, second and third determination or feature display areas of the gaming machine in FIG. 1, according to an embodiment of the present invention.

The game of the present invention utilizes a primary determination or display area 60 during the primary game. As shown in FIG. 3B, the present invention utilizes a first feature display area 60A, a second feature display area 60B, and a third feature display area 60C during the feature game. Further, in one embodiment, the third feature display area 60C is utilized as the primary display area 60. In the illustrated embodiment, the first and second feature display areas 60A, 60B are shown on the upper display 21 and the primary display area/third feature display area 60, 60C are show on the lower display 26. However, the present invention is not limited to such an arrangement. For example, the first and second features display areas 60A, 60B could be on the lower display 26 and the primary display area/third feature area 60, 60C could be displayed on the upper display 21. Alternatively, all display areas 60A, 60B, 60C, 60 could be shown on one large display.

In one embodiment of the present invention, the first and second feature display areas 60A, 60B, as well as the primary/third feature display areas 60, 60C are displayed during the primary and the feature game. However, during the primary game, the first and second feature display areas 60A, 60B are dimmed. The first and second feature display areas 60A, 60B may be dimmed in any manner to de-emphasize the display areas 60A, 60B or (effectively) highlight the primary display area 60. For example, the first and second feature display areas 60A, 60B may be converted to greyscale, may be made translucent or partially translucent, may appear less bright than the primary display area 60, or otherwise modified.

In one embodiment of the present invention, the first and second feature display areas 60A, 60B are displayed on the upper display 21 and the third feature display/primary display areas 60, 60C are displayed on the lower display 26. However, it should be noted that the present invention is not limited to such a configuration. For example, all three display areas 60A, 60B, 60C, 60 could be displayed on one display, on three or four separate displays, or some other configuration. Additionally, the primary display area 60 could be displayed separately or independently from the third feature display area 60C.

It should be noted that the present invention could include additional feature display areas. As discussed below, each feature display is used to display a respective feature outcome sequentially (or in turn). As each feature outcome is displayed, a predetermined symbol is copied from the feature outcome into the next display area (whose outcome has not been displayed). The predetermined symbols are cumulative, i.e., the predetermined symbol is copied into each display area in sequence, and thus, the predetermined symbols accumulate in the feature areas that occur next in the sequence.

The present embodiment shows the state of displaying the primary game screen on the lower display 26. As shown in FIG. 3A, this game screen has a determination area 60 for displaying symbols. By using such a game screen, the gaming machine 1 of the present embodiment operates as a slot machine that pays a payout according to a winning combination of symbols displayed on the determination area.

The display unit 27 displays a plurality of symbols in the display area 60. The determination area, or grid, 60 has a plurality of rows (r) and columns (c). The determination area 60 is configured by a plurality of cells 64 that are the stop position of symbols. Specifically, the display areas 60, 60A, 60B, 60C may be configured by 15 cells disposed in a grid shape of 3 rows and 5 columns. Further, omitted in FIGS. 3A and 3B, the display unit 27 can display a decorative area, and an area that displays credit amount, bet number, and a credit amount obtained by winning (WIN number) and the like, outside of the determination area 60. On each of the plurality of cells 64 of the display areas 60, 60A, 60B, 60C, one symbol is stopped and displayed.

Figure 4:
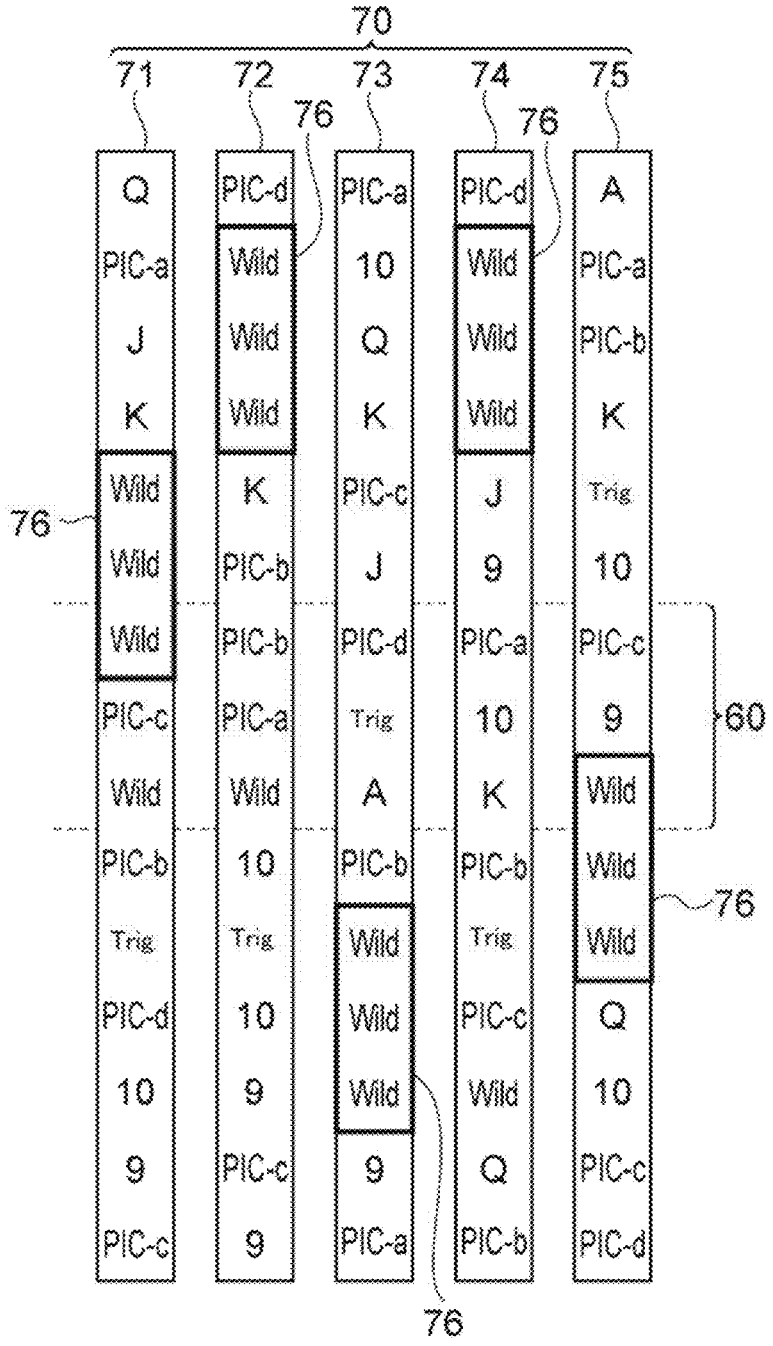
FIG. 4 is a figure showing one example of a symbol arrangement showing the order of symbols displayed on the display areas in FIGS. 3A and 3B.

On each cell 64 of the display areas 60, 60A, 60B, 60C, as shown in FIG. 4, a symbol is displayed based on the symbol arrangement of virtual reel strips 71 to 75 configured of a virtual reel set 70. That is, the cells 64 of the display areas 60, 60A, 60B, 60C correspond to the virtual reel strips 71 to 75 by column, and the symbols disposed on predetermined parts of each virtual reel strip 71 to 75 are displayed. Furthermore, as mentioned below, by moving (scrolling or spinning) each symbol by column based on the symbol arrangement of the virtual reel strips 71 to 75, the symbols displayed on the cells 64 of the determination area 60 change, and by stopping the movement (scrolling or spinning) by columns, the symbols are stopped. Here, the virtual reel strips 71 to 75 are data where the control unit 50 uses a program having the memory 53 or the storage 54, and data showing the symbol arrangement (i.e., the order of symbols on each reel) regulated by each cell column. Further, the virtual reel set 70 is a general term for such virtual reel strips 71 to 75.

In one embodiment, the same set of virtual reel strips 70 may be used for the primary game and each of the display areas 60A, 60B, 60C in the feature game. However, a first set of virtual reel strips may be used for the primary game, and a different set of virtual reel strips may be used for the feature game. Further, different reel strips may be used for each of the first, second, and third feature display areas 60A, 60B, 60C during the feature game. It should be noted that the present invention is not limited to any specific length of virtual reel, symbols, ranking of symbols and/or pay lines. Further, the configuration of virtual reel may be statically fixed, partially modified or dynamically configured during play of the games.

Figure 5:
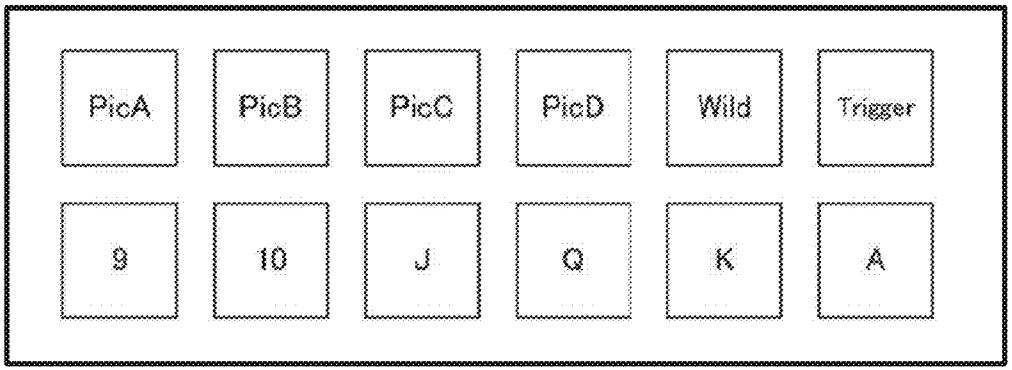
FIG. 5 is a figure showing the symbols displayed on the determination area in FIG. 3.

Each virtual reel strip 71 to 75, in an example of FIG. 4, is configured by 19 symbols and those symbols are aligned in an order defined by each reel. FIG. 5 shows the details of symbols of the figure shown in FIG. 4. Each virtual reel strip 71 to 75 includes symbols selected from a symbol set of 13 varieties shown in FIG. 5. This symbol set includes card symbols ("9", "10", "J", "Q", "K", and "A") that imitate playing cards as regular symbols, and picture symbols ("PIC-a", "PIC-b", "PIC-c", and "PIC-d") that show a pattern. Further, this symbol set includes a wild symbol ("Wild") that is substituted as another symbol when a win is determined and a trigger or symbol ("Trig") that is used to determine if a feature or feature game is to be played (see below). Each of these symbols have a different rank from each other regarding their value when winning, their rank gradually raises in this order: "9", "10", "J", "Q", "K", "A", "PIC-d", "PIC-c", "PIC-b", "PIC-a". A combination of symbols that includes high-ranking symbols when winning, can obtain a larger winning payout compared to a combination of low-ranking symbols when winning. Additionally, the symbol set may include one or more enlarged symbol stacks 76 on one or more of the set of virtual reel strips 70. The enlarged symbol stack 76 is a large symbol that covers at least two or more symbol positions. In one embodiment, each reel strip 70 includes at least one enlarged symbol 76. Each enlarged symbol stack covers at least the number of rows in the grid, such that once the reel strip has stopped, an entire column of the grid may be covered by an enlarged symbol stack. In a further embodiment, the enlarged symbol stack 76 may be any one of the symbols available (see FIG. 5). In the displayed embodiment, the enlarged symbol stack 76 is an enlarged "Wild" symbol stack.

The control unit 50 that starts a game, determines the stop position of each virtual reel strip 71 to 75 randomly, the virtual reel strips 71 to 75 move from a current position, and the operation to stop on a stop position uses the display unit 27 (for example, the lower display 26) and is expressed. Due to this, in the display or determination areas 60, 60A, 60B, 60C, the symbols included on the virtual reel strips 71 to 75 are continuously moved (scrolled or spun) in the vertical direction of the display area 60, 60A, 60B, 60C and one symbol of one cell 64 aligned in an order of the symbol based on the symbol arrangement is stopped so that it is displayed.

The control unit 50 changes and stops the plurality of symbols displayed on the display unit 27 according to the operation of the player received by the operation unit 44, and a payout is paid according to the stopped symbols inside the determination areas 60, 60A, 60B, 60C.

In each display areas 60, 60A, 60B, 60C, a pay line is set that is used when winning is determined. The pay line is set to be extended over the column on the right end from the cells of the column of the left end, and is a line that combines the plurality of cells 64 determining a win. The number of effective lines within the set pay line is selected by the operation of a group of line designation buttons included in the group of setting buttons 46 of the operation unit 44 for the player. The control unit 50, in regards to the result of a game that is a combination of symbols, determines a win when a predetermined number of identical symbols is surpassed and aligned on a set pay line, and pays a payout to the player according to the type and number of symbols. On the gaming machine 1 of the present embodiment, a predetermined number of pay lines (LINE 1-40) of cells with three rows and five columns in the display areas 60, 60A, 60B, 60C is set (reference FIG. 6). The system for determining a win may determine a win when a predetermined number of identical symbols from cells of the column on the left end are aligned on a set pay line, may determine a win when a predetermined number of identical symbols from cells of the column on the right end are aligned on a set pay line, and may determine a win when a predetermined number of identical symbols are aligned on a continuous column on a predetermined pay line.

Figure 6:
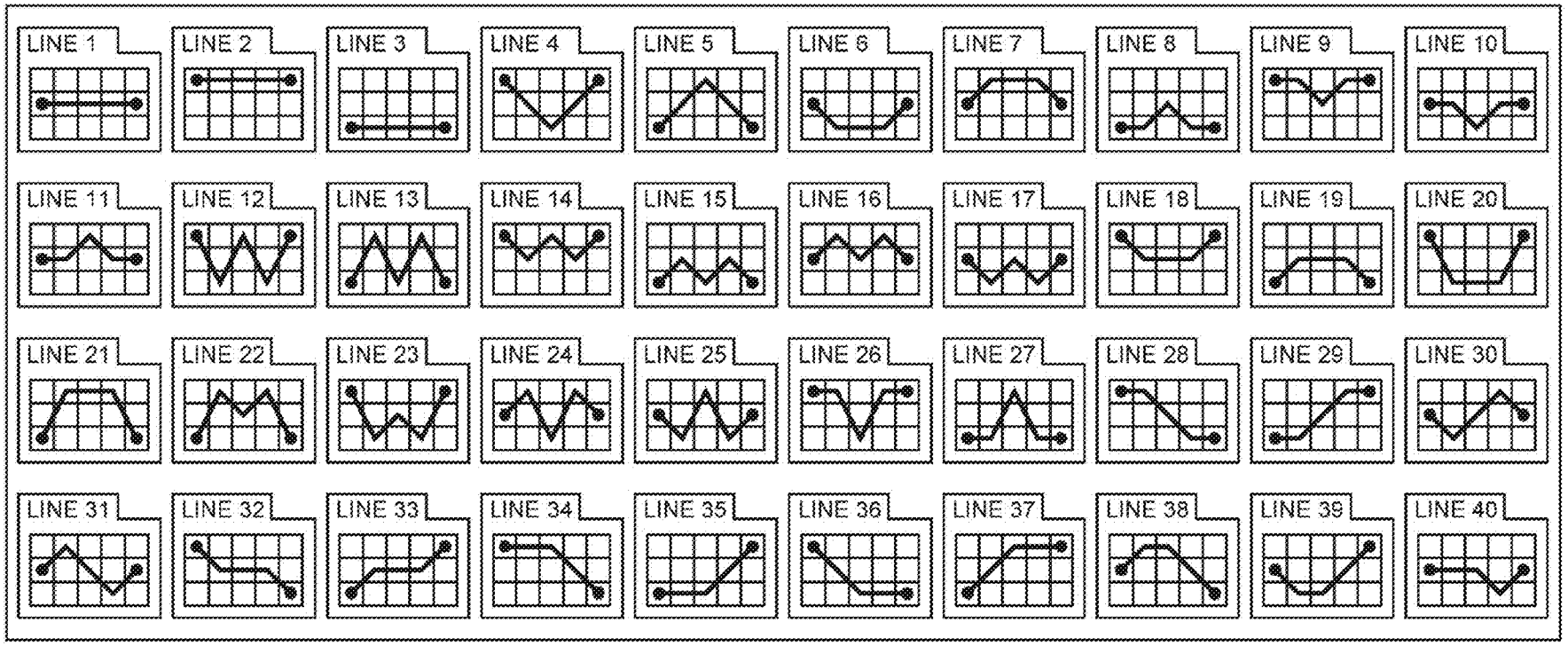
FIG. 6 is a figure showing one example of a pay line set on the determination area in FIG. 3.

It should be noted that pay lines shown other than (or in addition to) the pay lines shown in FIG. 6 may be used. In general, the pay lines shown in FIG. 6 start in the first column and end in the last column, and include one cell per column. However, one or more pay lines could include one or more cells in the same column and may include a vertical pay line.

The gaming machine 1 of the present embodiment may provide two types of games, a primary game (also referred to as a main game) and a special game (referred to as a bonus game, or feature game, and includes providing one or more free games or spins that do not consume game value)

provided when predetermined conditions are satisfied. Concerning a primary game and a feature game, the symbols displayed in the display area 60 configure a combination of symbols that are the result of a game, and determine a win.

It should be noted that the present invention is not limited to any specific length of virtual reels, symbols, ranking of symbols and/or pay lines.

With particular reference to FIGS. 3A, 3B and 7-21, a first embodiment of the present invention will be discussed. As mentioned above, the present invention may provide a main game and a feature game. The main game, e.g., a video slot game, may be played on a primary determination area or grid 60A. As shown in FIG. 3A, in the first embodiment a 3×5 grid of cells 64 may be used. In one embodiment, the main game may be repeatedly played or provided by the control unit 50 until a trigger condition has been met. For instance, in one embodiment the trigger condition may be defined as the appearance of a predetermined number of trigger symbols ("Trig") in an outcome of the main game. It should be noted that the trigger condition may be any suitable condition or set of conditions that may occur in the main game, or occur independent of the main game, e.g., from an outside source, such as a player tracking system. The trigger condition may be a mystery trigger event, i.e., an event which, while related to the main game, is not visible or part of or shown within the outcome of the main game.

Once the trigger condition has been met, a bonus or feature (feature game) may be provided.

In the first embodiment of the present invention, the feature game provides a predetermined number of free instances of a game, e.g., free spins of a video slot game. Each free instance includes an instance of sub-game played on each of the feature symbol display areas 60A, 60B, 60. The predetermined number of free instances may be fixed or may be determined once the trigger condition has been detected. For example, in the first embodiment, the predetermined number of free spins may be randomly determined. Alternatively, the number of free spins may be determined based on the trigger condition, for instance, the number of the trigger symbols.

In one aspect of the present invention, each free instance of the feature game includes a sub-game played on each of the feature symbol display areas 60A, 60B, 60C. In the illustrated embodiment, the present invention includes three feature symbol display areas 60A, 60B, 60C, and thus, each free spin or instance of the feature game includes three sub-games. However, it should be noted that the present invention could include two sub-games, or more than three sub-games. Generally, the present invention would include a separate feature display area for each sub-game.

Figure 7:
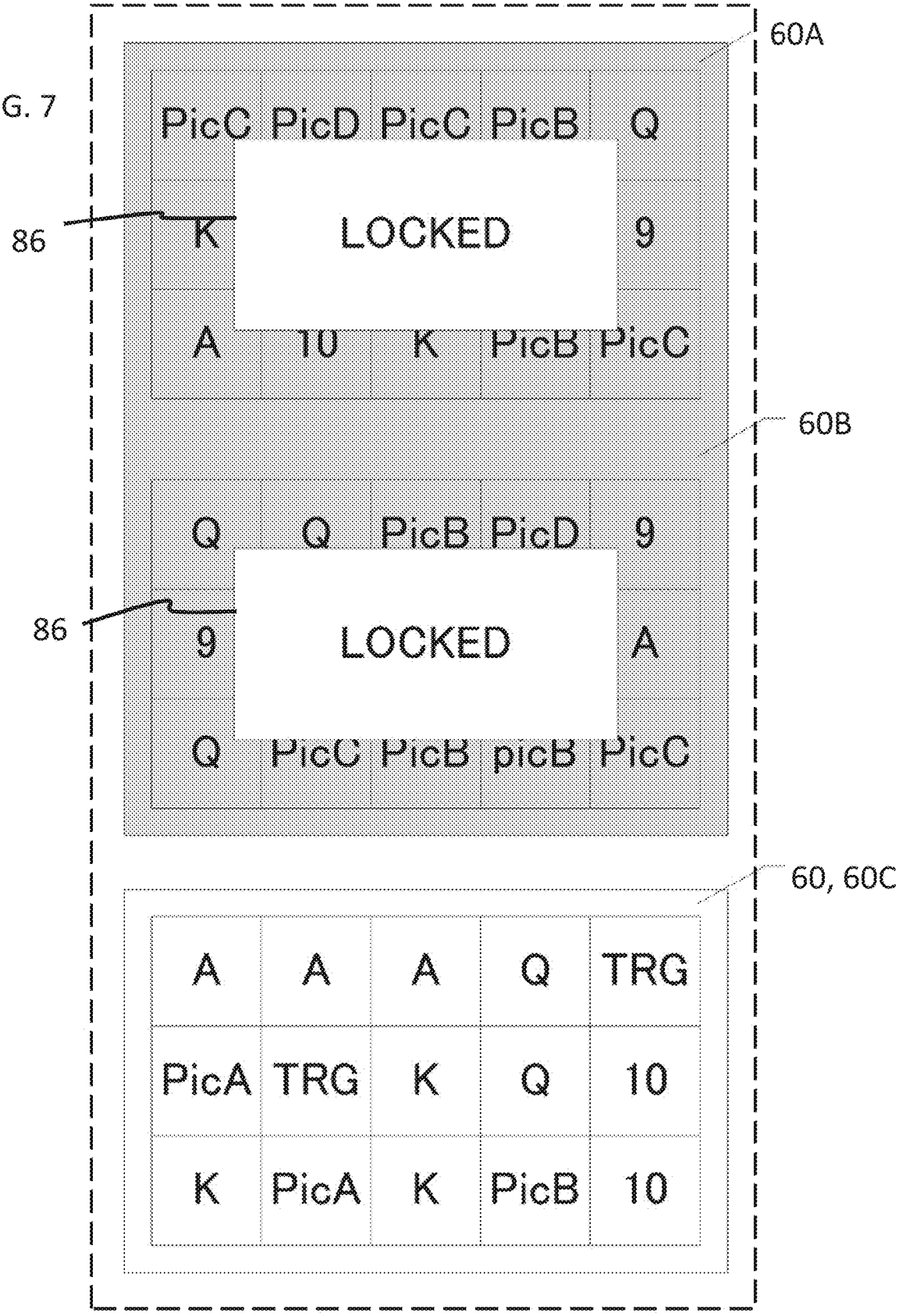
FIG. 7 is a diagrammatic illustration of the feature display areas of the gaming machine in FIG. 1 during a primary game, according to an embodiment of the present invention.

With reference to FIG. 7, the first, second, and third feature display areas 60A, 60B, 60C are shown during the primary game. In the illustrated embodiment, the third feature display area 60C also functions as the primary display area 60. The primary game is provided via the primary display area 60. In the illustrated embodiment, the primary game is a video slot. During the primary game, the control unit 50 spins the reels or reel strips 70 randomly, via a random number generator (RNG), determines a stop position and stops the reels 70 based on an output of the RNG. The symbols from the reel strips 70 that are displayed in the primary display area 60 form a primary game outcome. The control unit 50 evaluates the primary game outcome and pays an award to the player if the primary game outcome is a winning outcome. Generally, a game outcome is determined as a winning outcome based on a predetermined pay table.

As shown in FIG. 7, during the primary game, the first and second feature display areas 60A, 60B are locked and "dimmed" in order to emphasize that the first and second display areas 60A, 60B are not being used. In addition, a graphic 86 (labeled "locked") may be displayed over each of the first and second feature display areas 60A, 60B.

The primary game may be repeatedly played by the player until the feature game is triggered. As discussed above, once the trigger condition has been detected, the feature game is initiated. In general, during the feature game, a number of free spins of the feature game may be provided. However, each free spin includes a sub-game played on each of the display areas. In the illustrated embodiment, each sub-game is a video slot game played on the respective feature display areas 60A, 60B, 60C.

A first set of symbols associated with the first feature symbol display area 60A is randomly established, e.g., using the RNG. The established set of first symbols are displayed on the first feature symbol display area 60A. The first set of symbols form a first feature outcome. The first feature outcome is analyzed to determine if a first instance of a predetermined symbol appears in the first feature outcome (see below).

A second set of symbols associated with the second feature display area is randomly established, e.g., using the RNG. The first instance of the predetermined symbol (if detected) from the first feature symbol display area 60A is copied to the second feature symbol display area 60B. At least a part of the set of second symbols is also displayed in the second feature display area 60B. If an instance of the predetermined symbol did not appear in the first feature outcome, the whole set of second symbols is displayed in the second feature display area 60B. If an instance of the predetermined symbol appeared in the first feature outcome, then it is copied into the same cell(s) of the second feature display area 60B in which the predetermined symbol appeared in the first feature display area 60A. In the other cells of the second feature display area 60B, the respective symbols of the set of second symbols are displayed (see below).

The (at least a part of the) set of second set of symbols and the first instance of the predetermined symbol form a second feature outcome. The second feature outcome is analyzed to determine if a second instance of a predetermined symbol appears in the second feature outcome.

A third set of symbols associated with the third feature display area 60C is randomly established, e.g., using the RNG. The first instance of the predetermined symbol (if detected) and the second instance of the predetermined symbol (if detected) from the second feature symbol display area 60B is copied to the third feature symbol display area 60C. At least a part of the set of third symbols is also displayed in the third feature display area 60C. If an instance of the predetermined symbol did not appear in the first feature outcome or the second feature outcome, the whole set of third symbols are displayed in the third feature display area 60C. If an instance of the predetermined symbol appeared in the first feature outcome or the second feature outcome, then it is copied into the same cell(s) of the third feature display area 60C in which the predetermined symbol appeared in the second feature display area 60B. In the other cells of the third feature display area 60C, the respective symbols of the set of third symbols are displayed (see below).

It should be noted that more than one instance of the predetermined symbol may appear in the first feature outcome, or the second feature outcome. In one embodiment, all instances of the predetermined symbol are copied into the subsequent feature outcome.

As discussed above, in one embodiment, the control unit 50 provides the instance of the primary game utilizing the third feature display area 60C. In one embodiment, the primary game is also a video slot game.

The set of possible symbols or symbols on the reels 70 (see FIGS. 4 and 5) may include a trigger symbol ("Trig"). In one embodiment, the feature trigger condition is the appearance of a predetermined number of trigger symbols within the primary outcome. The predetermined number of trigger symbols may be fixed, e.g., 3, may be randomly determined or may be based on other factors.

In one embodiment, the control unit 50 is configured to award the player a primary award as a function of the primary outcome. The award may also be determined as a function of the pay lines played by the player, the primary outcome and a predetermined pay table. Additionally, the control unit 50 may be configured to award the player a feature award as a function of at least one of the first feature outcome, the second feature outcome and the third feature outcome. In one embodiment, first, second and third feature awards are provided to the player as a function of the first feature outcome, the second feature outcome and the third feature outcome, respectively. The first, second and third feature awards may be determined as a function of the respective outcome, the player pay lines, and a respective pay table.

As discussed above, the primary game and each sub-game of the feature games are video slot games. Each grid or display area includes a plurality of columns. Each column has an associated virtual reel. The control unit 50 is configured to rotate and stop the virtual reel(s) during the primary and feature games.

As shown in the examples below, in one embodiment the predetermined symbol is an enlarged stack symbol that spans a number of cells. The predetermined symbol is determined to appear in an outcome of a feature game if the predetermined symbol covers all of the cells in a single column. In the illustrated embodiments, the enlarged stack symbol is an enlarged Wild stack symbol. However, it should be noted that the enlarge stack symbol may be any symbol and may be randomly determined for each spin/game/sub-game.

Figure 8:
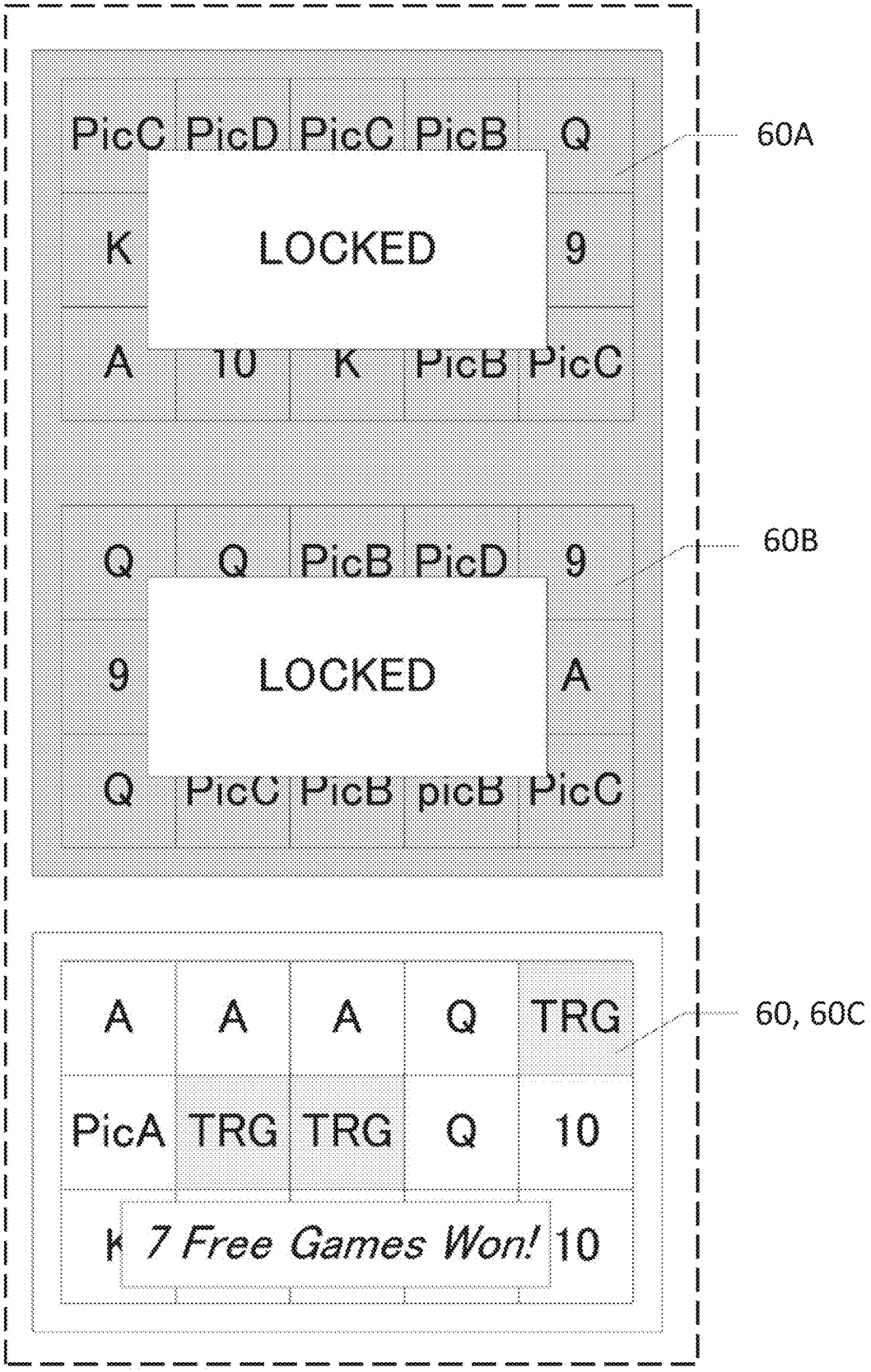
FIG. 8 is a second diagrammatic illustration of the feature display areas of the gaming machine in FIG. 1 during a primary game, according to an embodiment of the present invention.

With reference to FIG. 8, the first and second feature display areas 60A, 60B are locked and dimmed. The primary game has been played and a primary outcome is displayed in the primary display area 60. In the illustrated embodiment, the primary outcome includes three trigger symbols ("Trig"). In this embodiment, the trigger condition has occurred if three (or more) trigger symbols appears in the primary game outcome. Thus, the feature game is initiated. In this embodiment, 7 free games have been awarded to the player.

Figure 9:
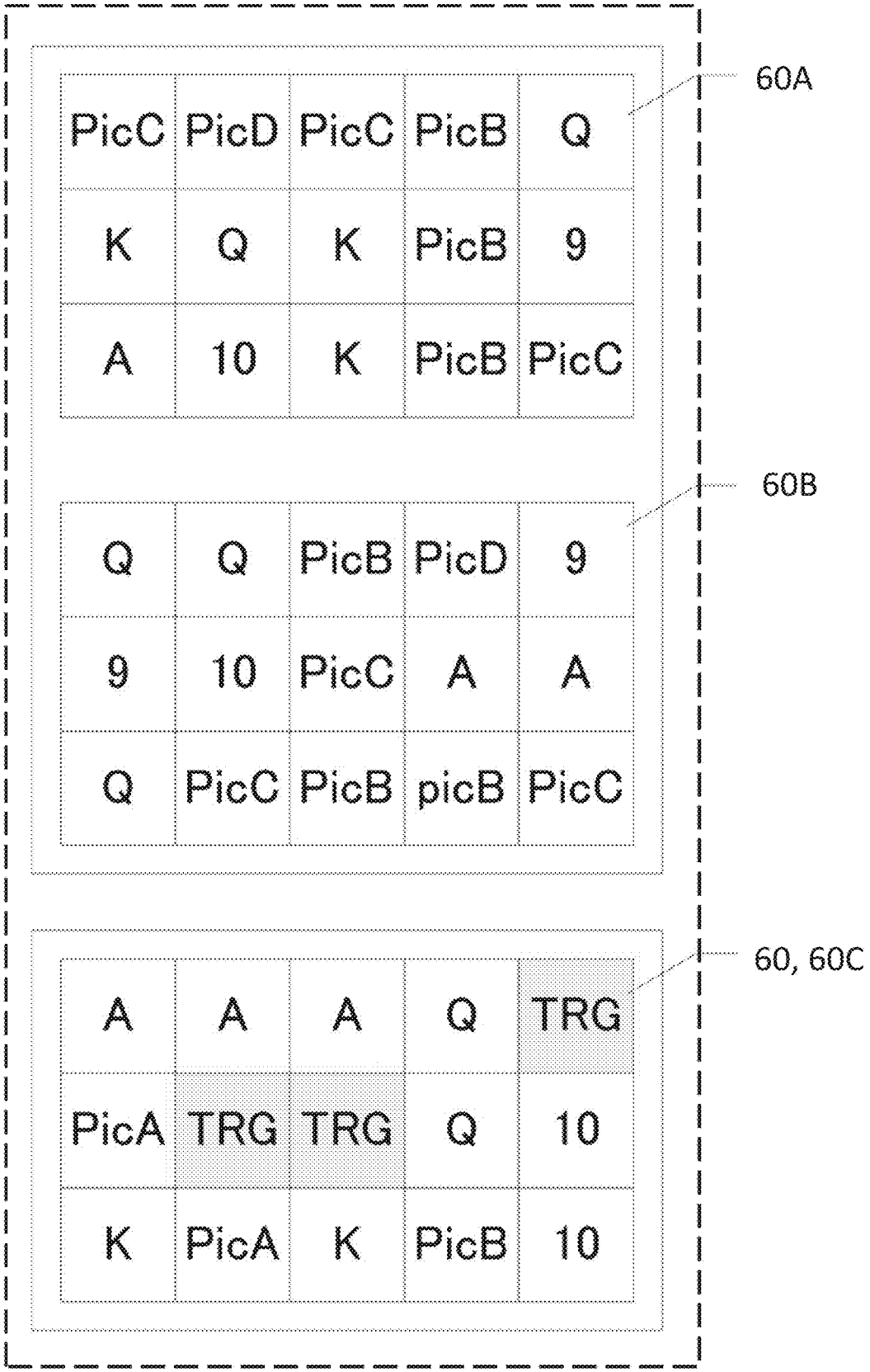
FIG. 9 is a first diagrammatic illustration of the feature display areas of the gaming machine in FIG. 1 during a feature game, according to an embodiment of the present invention.

Once the feature game has been initiated, the first and second display areas 60A, 60B are unlocked and un-dimmed (see FIG. 9).

Figure 10:
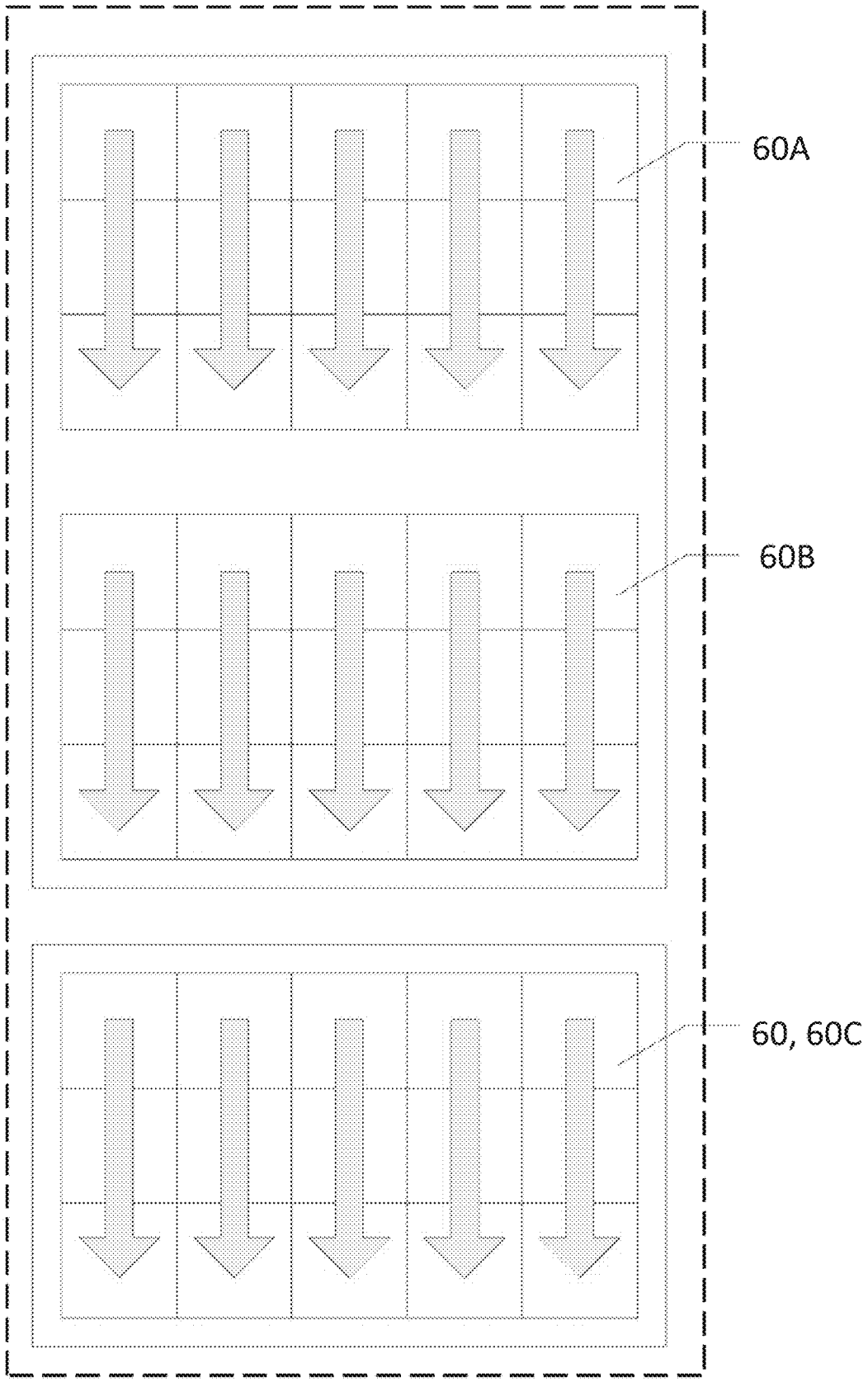
FIG. 10 is a second diagrammatic illustration of the feature display areas of the gaming machine in FIG. 1 during a feature game, according to an embodiment of the present invention.

In the illustrated embodiment, all of the reels associated with the first, second and third feature display areas 60A, 60B, 60C are set to spin (see FIG. 10).

Figure 11:
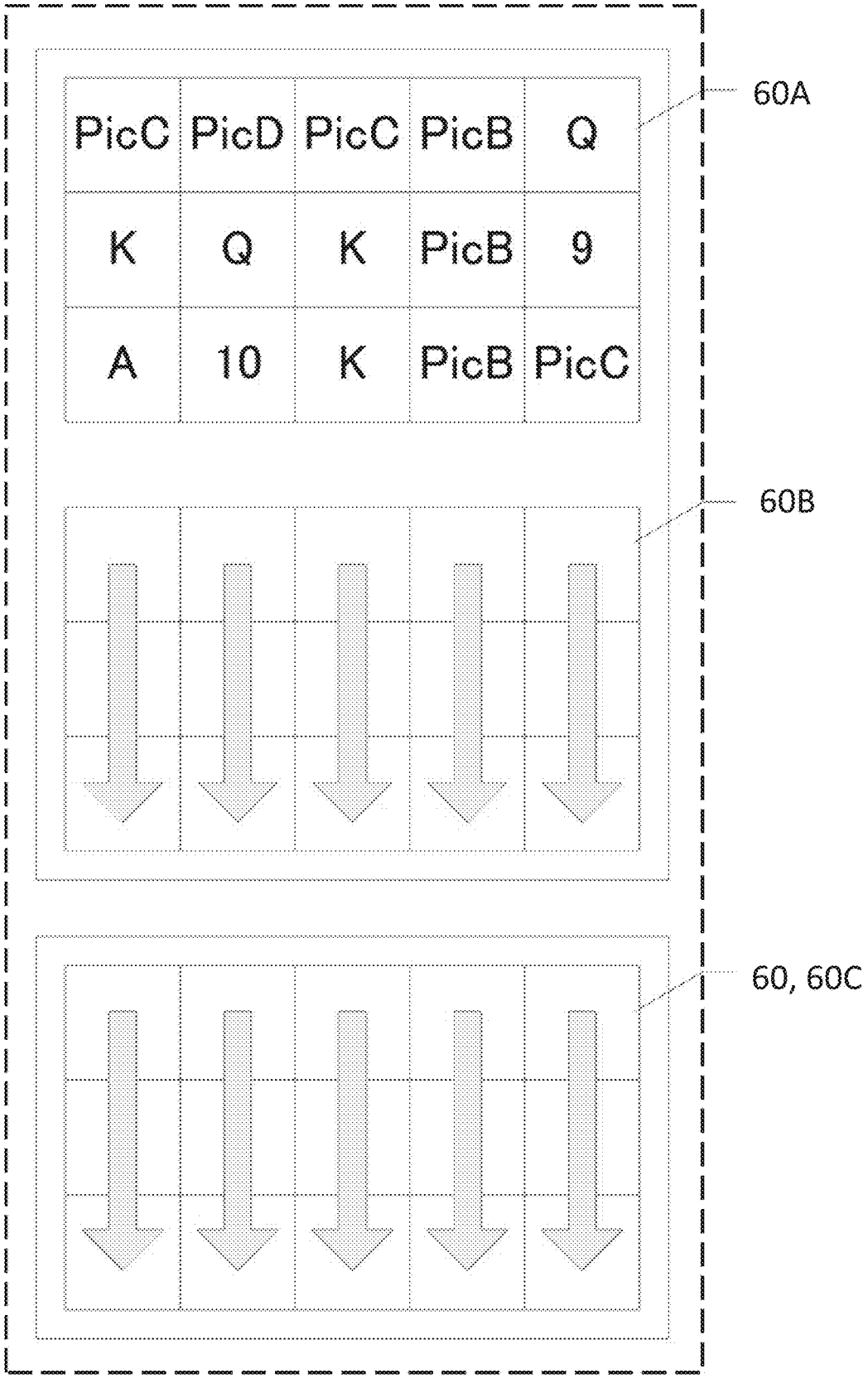
FIG. 11 is a third diagrammatic illustration of the feature display areas of the gaming machine in FIG. 1 during a feature game, according to an embodiment of the present invention.

With reference to FIG. 11, the reels (reels 1-5) of the first display area 60A are stopped. The reels may be stopped at the same time and at some predetermined sequence, e.g., left to right. Once the reels of the first display area 60A have been stopped, the displayed symbols form the first feature outcome. The first feature outcome is then analyzed and if the first feature outcome is a winning outcome, then a first feature award is awarded to the player. In the first feature outcome shown in FIG. 11, the predetermined symbol does not appear, so no symbol is copied from the first feature outcome/display area 60A to the second display area 60B.

Figure 12:
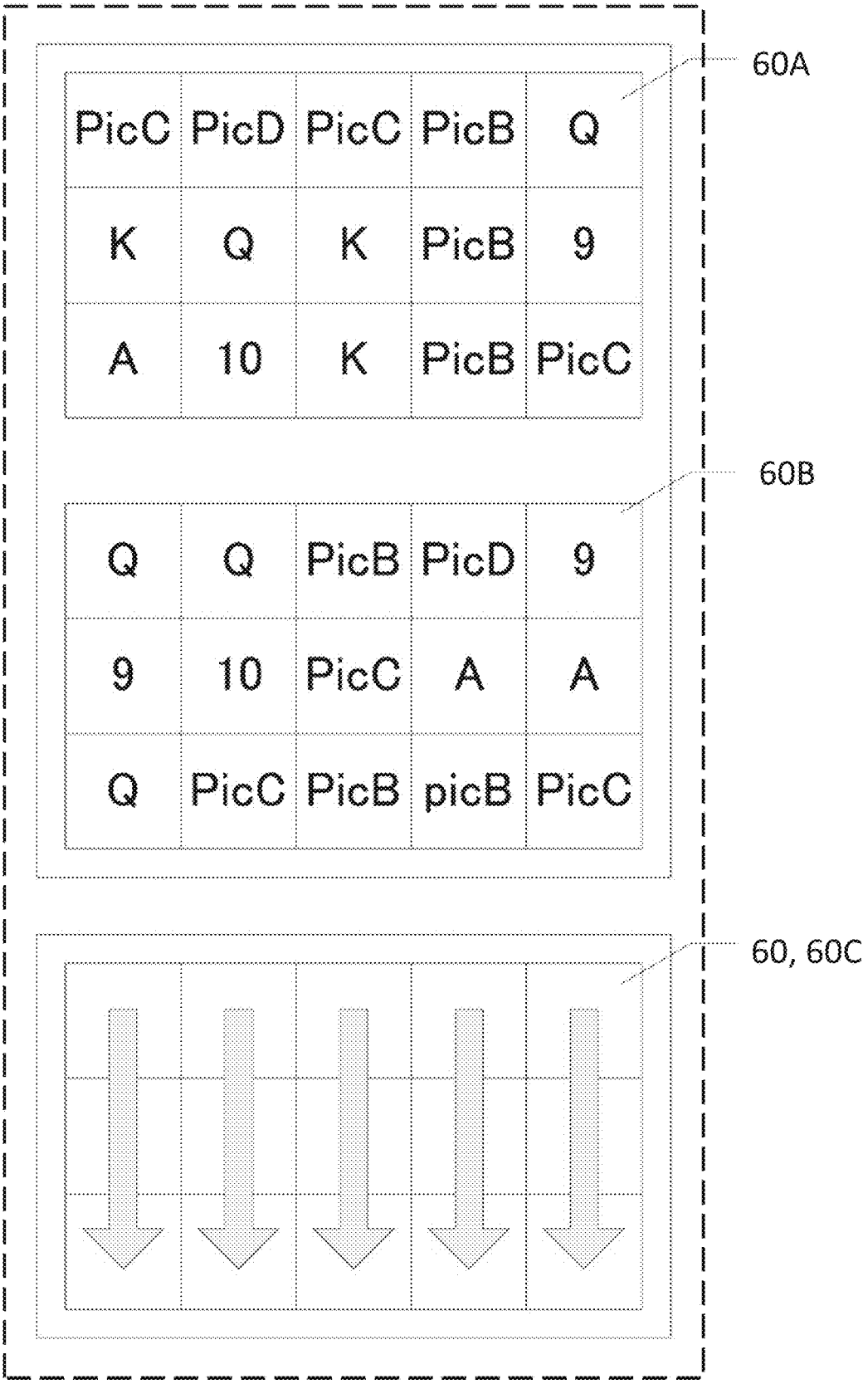
FIG. 12 is a fourth diagrammatic illustration of the feature display areas of the gaming machine in FIG. 1 during a feature game, according to an embodiment of the present invention.

With reference to FIG. 12, the reels (reels 1-5) of the second display area 60B are stopped. The reels may be stopped at the same time and at some predetermined sequence, e.g., left to right. Once the reels of the second display area 60B have been stopped, the displayed symbols form the second feature outcome. The second feature outcome is then analyzed and if the second feature outcome is a winning outcome, then a second feature award is awarded to the player. In the second feature outcome shown in FIG. 11, the predetermined symbol does not appear, so no symbol is copied from the second feature outcome/display area 60B to the third display area 60C.

Figure 13:
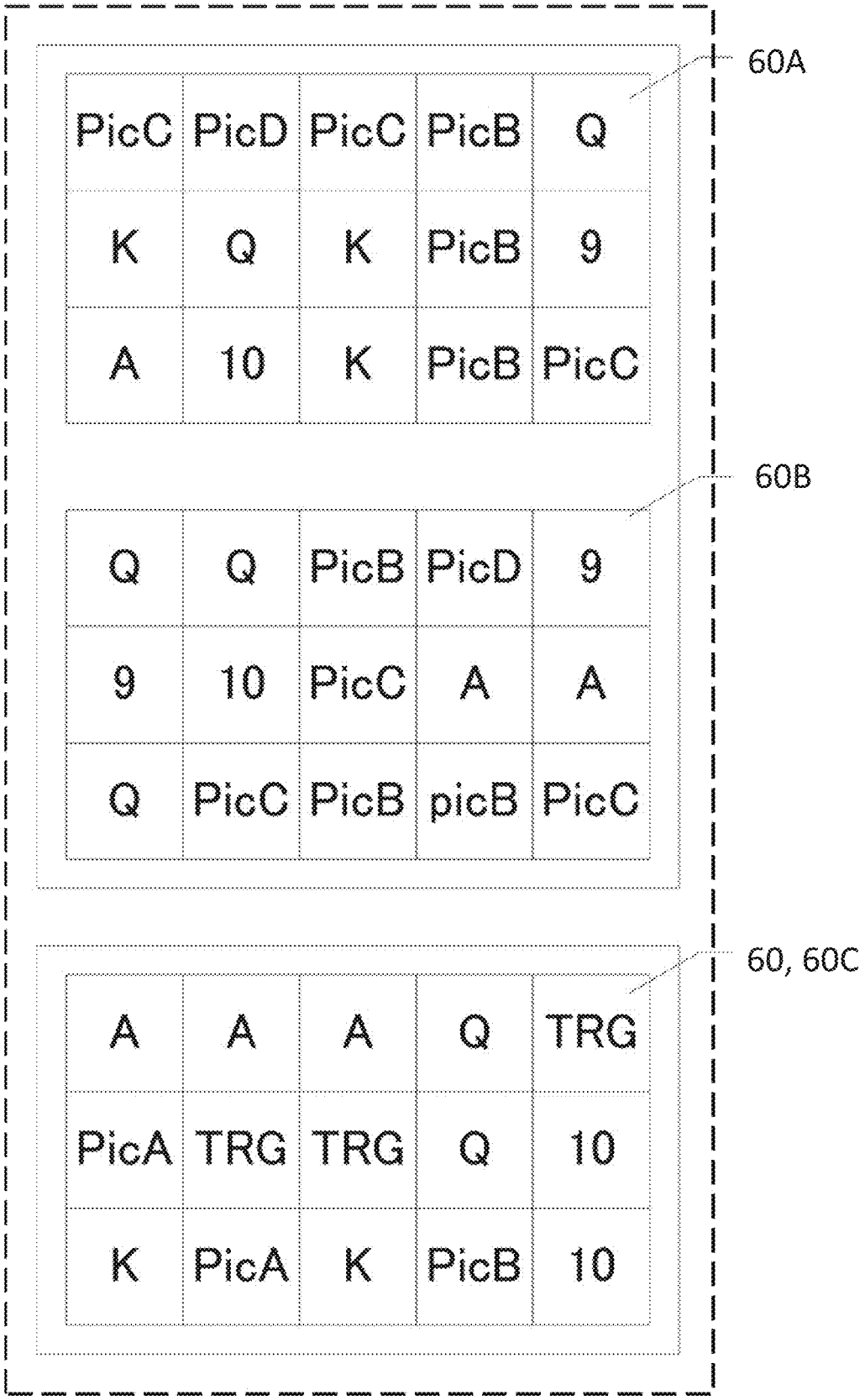
FIG. 13 is a fifth diagrammatic illustration of the feature display areas of the gaming machine in FIG. 1 during a feature game, according to an embodiment of the present invention.

With reference to FIG. 13, the reels (reels 1-5) of the third display area 60C are stopped. The reels may be stopped at the same time and at some predetermined sequence, e.g., left to right. Once the reels of the third display area 60C have been stopped, the displayed symbols form the third feature outcome. The third feature outcome is then analyzed and if the third feature outcome is a winning outcome, then a third feature award is awarded to the player.

As discussed above, each of the first, second and third outcomes may be analyzed after the respective reels have stopped. However, in an alternative embodiment, the first, second and third outcomes may be analyzed (and a payout award based on the analysis) after the reels associated with all three feature display areas 60A, 60B, 60C have stopped.

Figure 14:
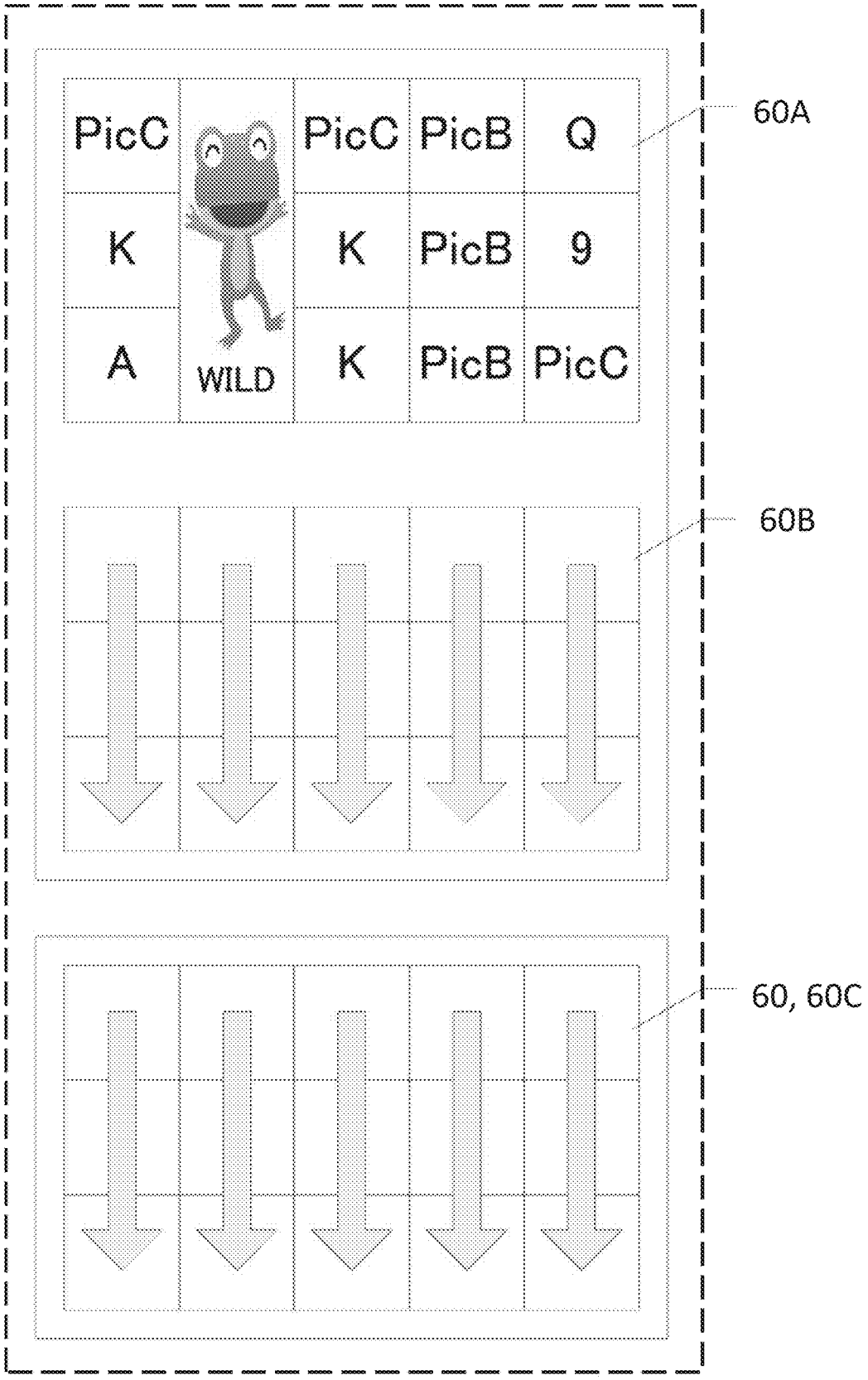
FIG. 14 is a sixth diagrammatic illustration of the feature display areas of the gaming machine in FIG. 1 during a feature game, according to an embodiment of the present invention.

With reference to FIGS. 14-20, the next free instance or play of the feature game is shown. With reference to FIG. 14, the reels associated with the first, second and third display areas 60A, 60B, 60C all started spinning, and the reels associated with the first display area 60A are stopped. The symbols displayed in the first display area 60A form the first feature outcome. As shown, the first feature outcome includes a full column wild (shown as a frog symbol) on the second reel. The first feature outcome may be evaluated once the reels associated with the first feature display area 60A have stopped, or may be evaluated once the reels associated with all three display areas 60A, 60B, 60C have stopped.

Figure 15:
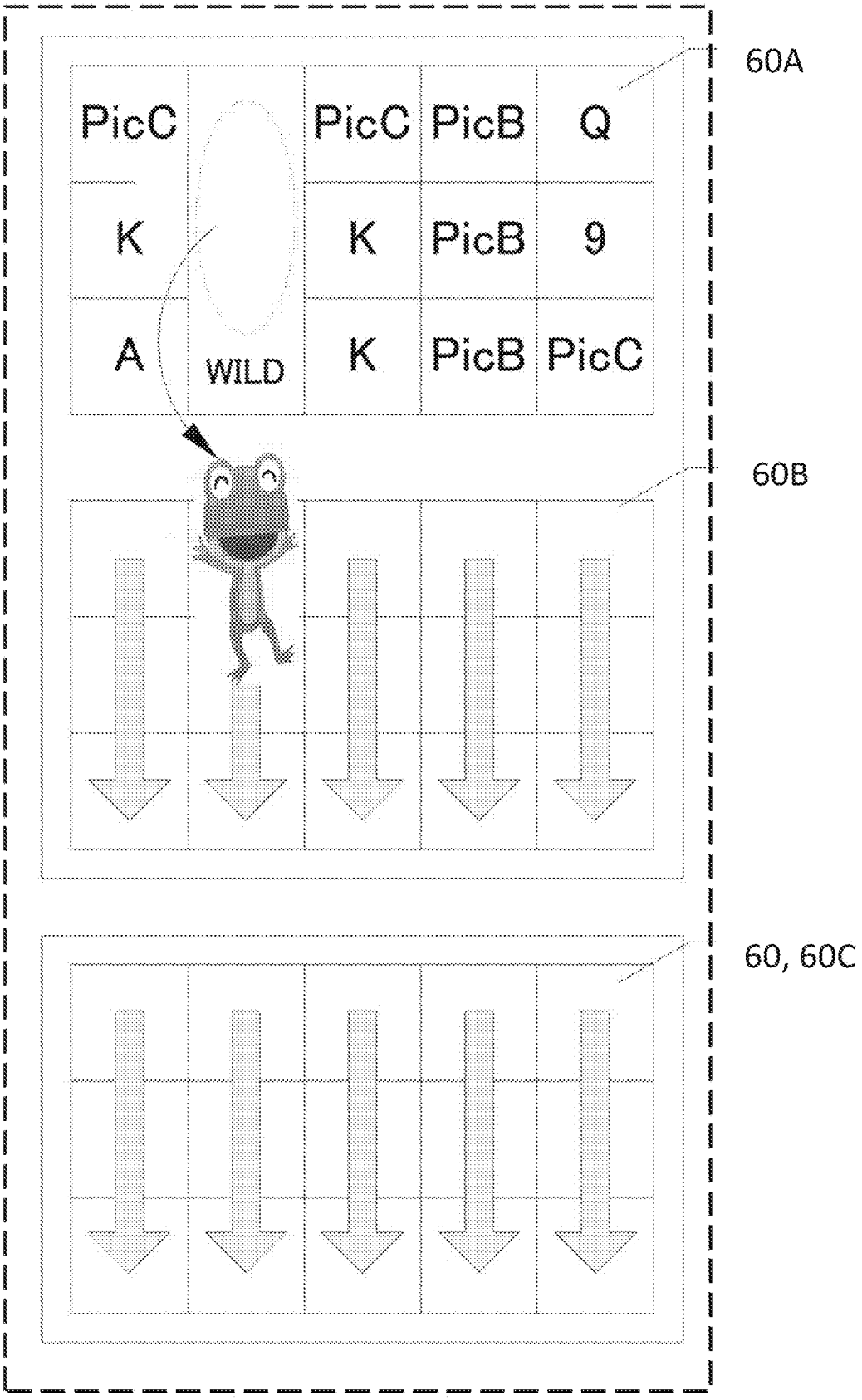
FIG. 15 is a seventh diagrammatic illustration of the feature display areas of the gaming machine in FIG. 1 during a feature game, according to an embodiment of the present invention.
Figure 27:
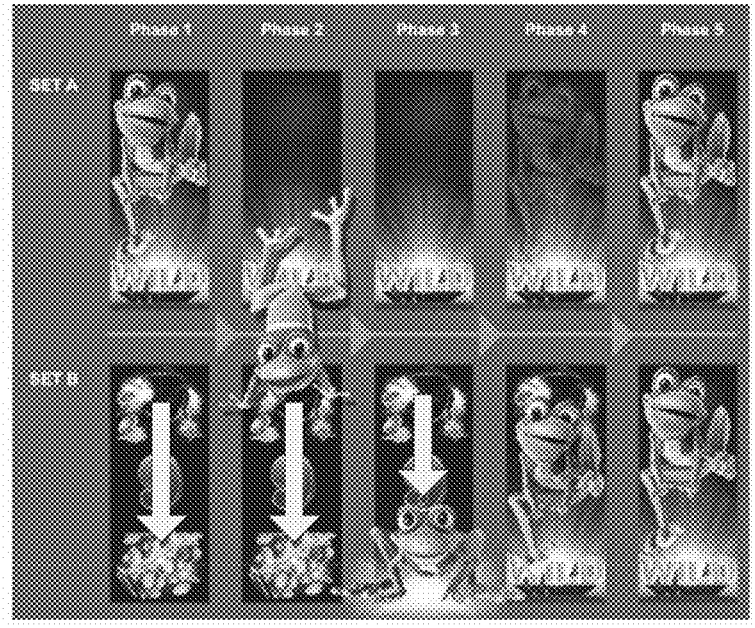
FIG. 27 is an illustration of an animation used in an exemplary embodiment of the present invention.

With reference to FIG. 15, in the illustrated embodiment, while the reels of the second display area 60B are still spinning, the instance of the predetermined symbol that has appeared in the first feature outcome is copied into the second column of the second feature display area 60B. As shown in the illustrated embodiment, the reels of the second and third feature display areas 60B, 60C are still spinning, while the instance of the predetermined symbol is copied into the second display area 60B. A suitable animation may be used (see FIG. 27 also). For instance, the frog in the instance of the predetermined symbol displayed in the first feature display 60A may appear to jump to the second display area 60B in the animation. In the illustrated embodiment, the frog jumps to the reel on the second display area 60B right underneath the reel on which it appears, i.e., the second reel. However, it should be noted that the instance of the predetermined symbol may be copied to a different cell or column, e.g., a randomly determined cell or column.

Figure 16:
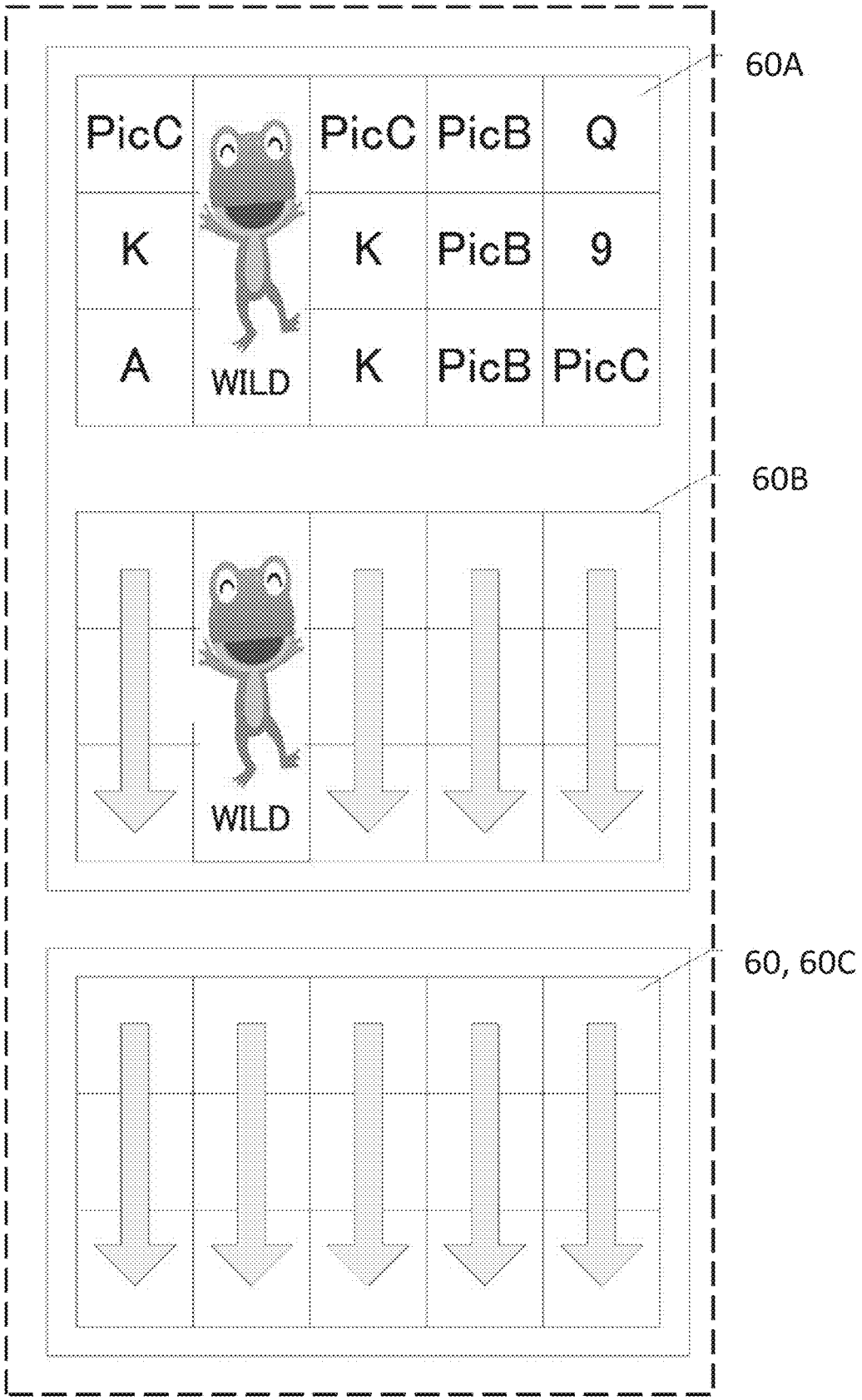
FIG. 16 is an eighth diagrammatic illustration of the feature display areas of the gaming machine in FIG. 1 during a feature game, according to an embodiment of the present invention.

As shown in FIG. 16, in the illustrated embodiment, once the animation has finished, the enlarged wild symbol is shown in both the first and second display areas 60A, 60B. As shown, the rest of the reels in the second display area 60B (and the reels of the third display area 60C) are still spinning.

Figure 17:
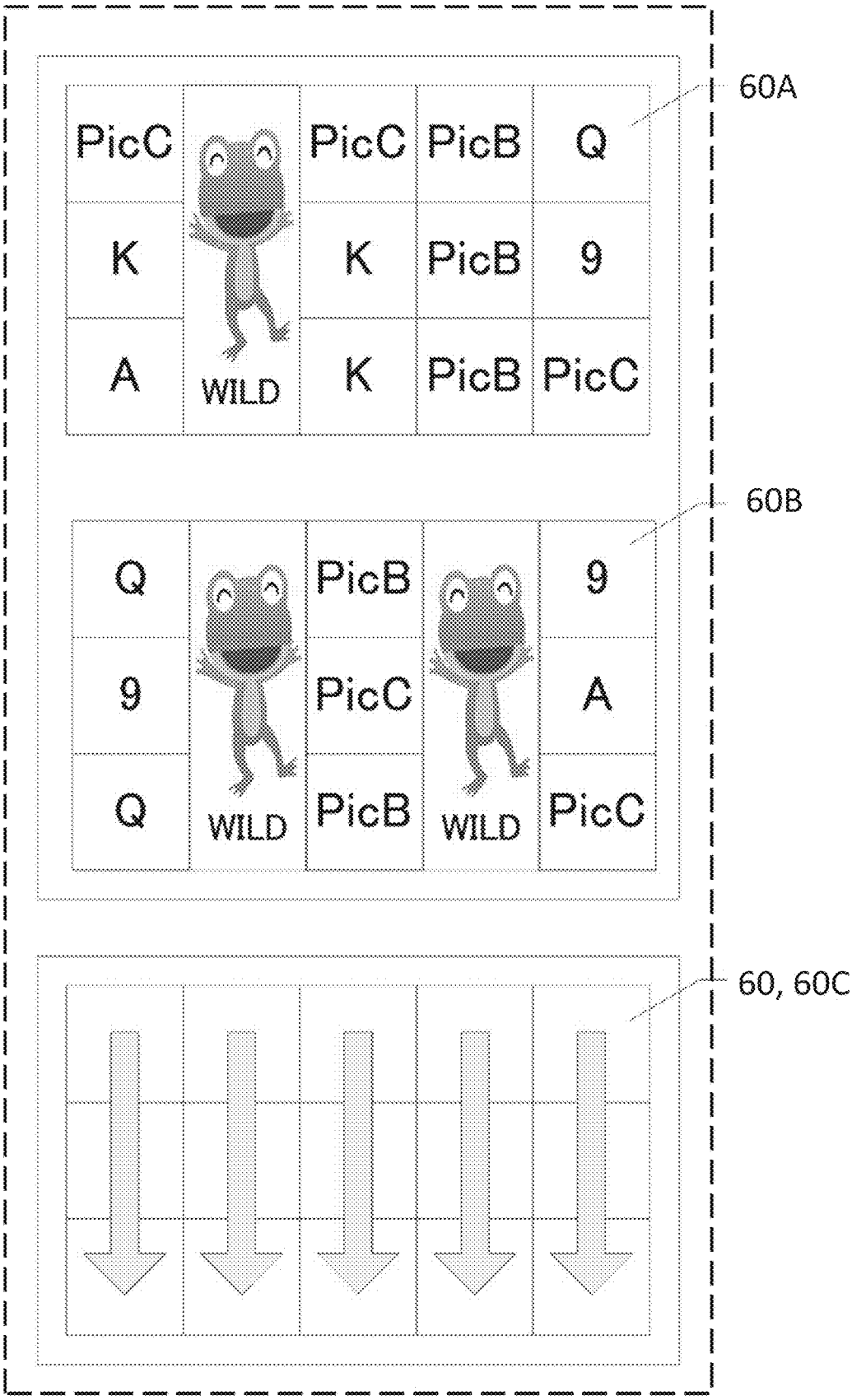
FIG. 17 is a ninth diagrammatic illustration of the feature display areas of the gaming machine in FIG. 1 during a feature game, according to an embodiment of the present invention.

As shown in FIG. 17, the remaining reels in the second display area 60B are stopped. The symbols displayed in the second display area 60B (including the instance of the predetermined symbol copied from the first display area 60A) form the second feature outcome. As shown, the second feature outcome includes a second full column wild (shown as a frog symbol) on the fourth reel. The second feature outcome may be evaluated once the reels associated with the second feature display area 60B have stopped, or may be evaluated once the reels associated with all three display areas 60A, 60B, 60C have stopped.

Figure 18:
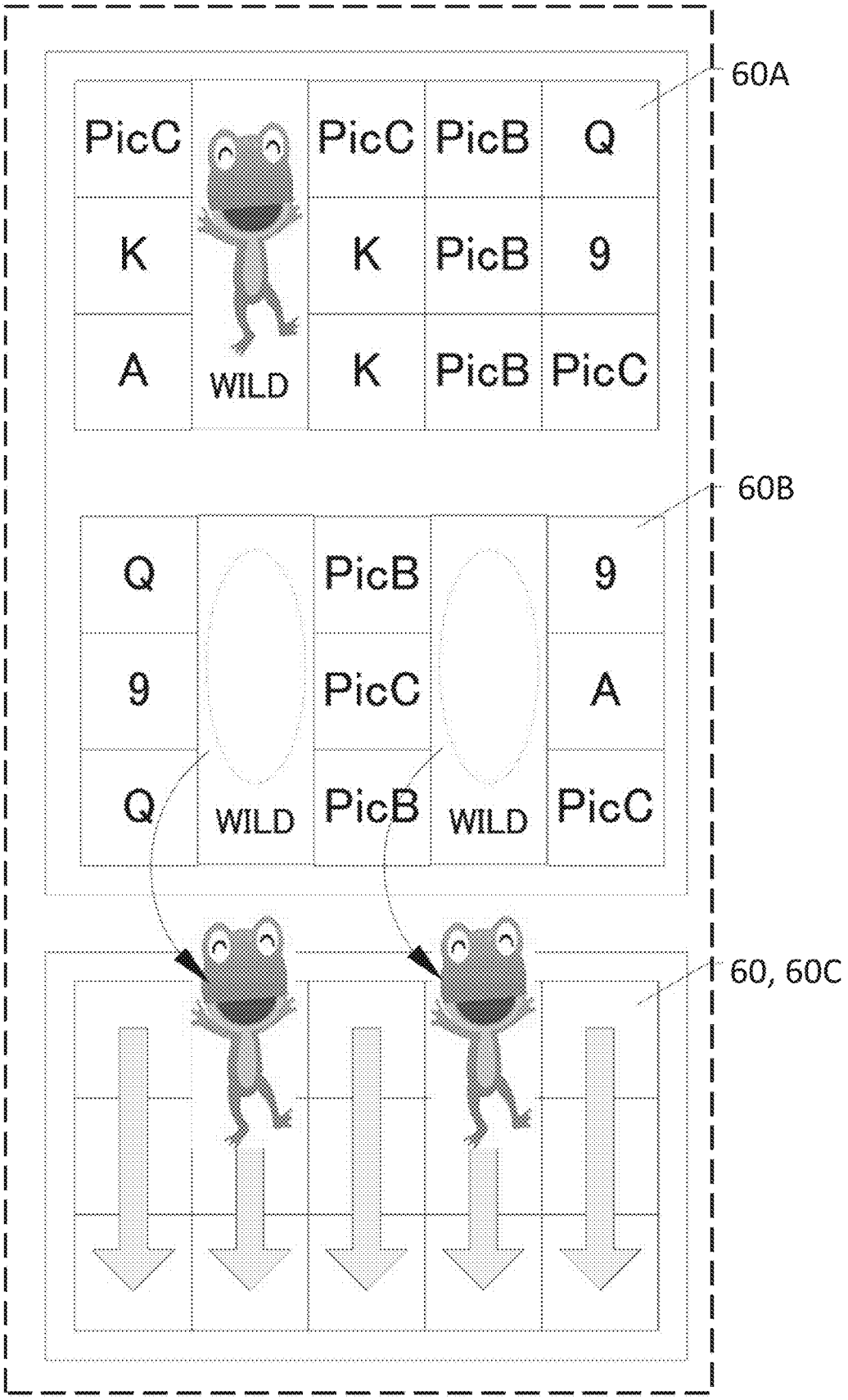
FIG. 18 is a tenth diagrammatic illustration of the feature display areas of the gaming machine in FIG. 1 during a feature game, according to an embodiment of the present invention.
Figure 19:
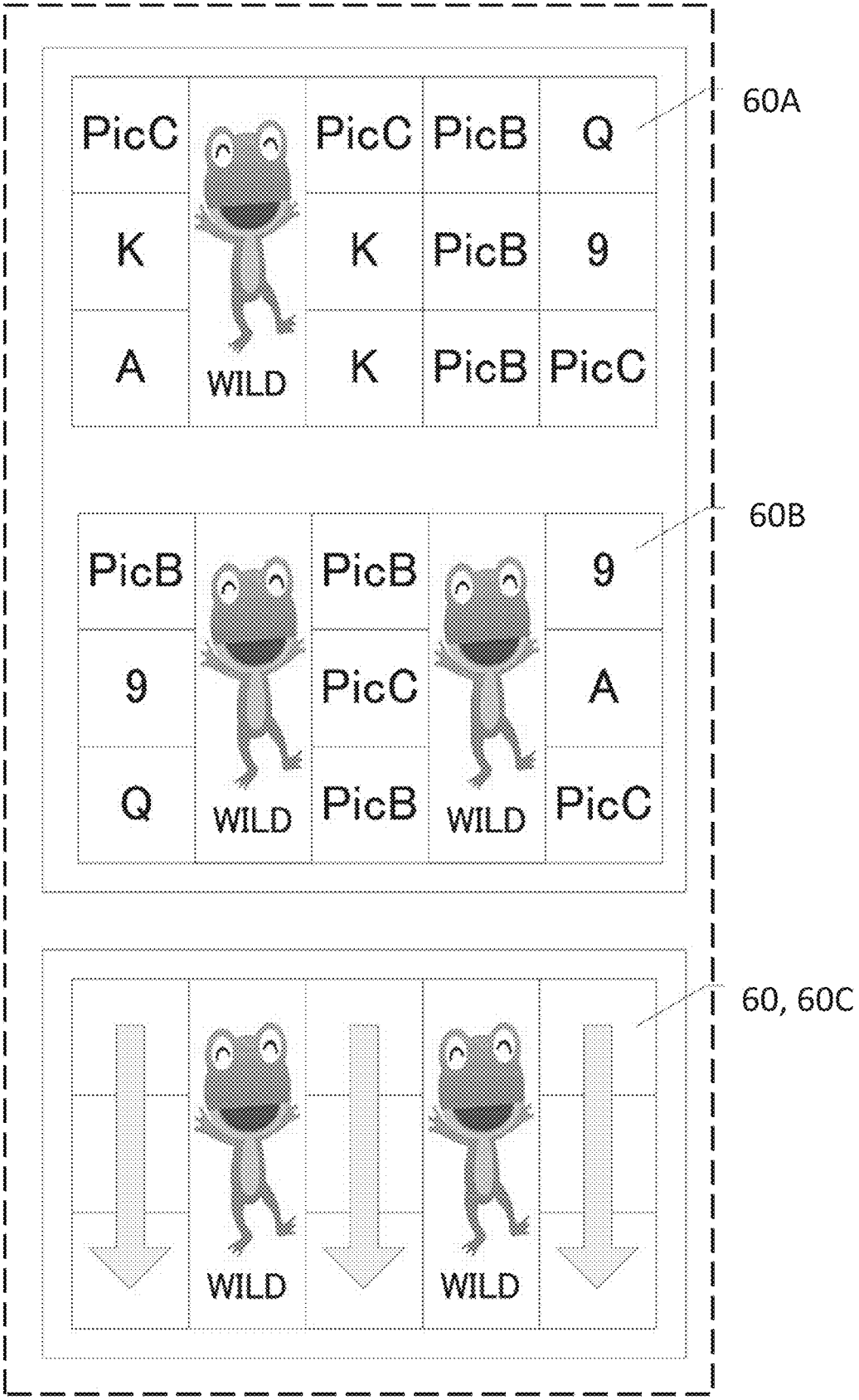
FIG. 19 is an eleventh diagrammatic illustration of the feature display areas of the gaming machine in FIG. 1 during a feature game, according to an embodiment of the present invention.

With reference to FIG. 18, in the illustrated embodiment, while the reels of the third feature display area 60C are still spinning, the instance of the predetermined symbol that was copied from the first feature outcome and the instance of the predetermined symbol in the second feature outcome are copied into the second and fourth columns of the third feature display area 60C, respectively. As shown in the illustrated embodiment, the reels of the third feature display areas 60C are still spinning (see FIG. 19 also), while the instances of the predetermined symbol are copied into the third display area 60C. A suitable animation may be used (see above).

Figure 20:
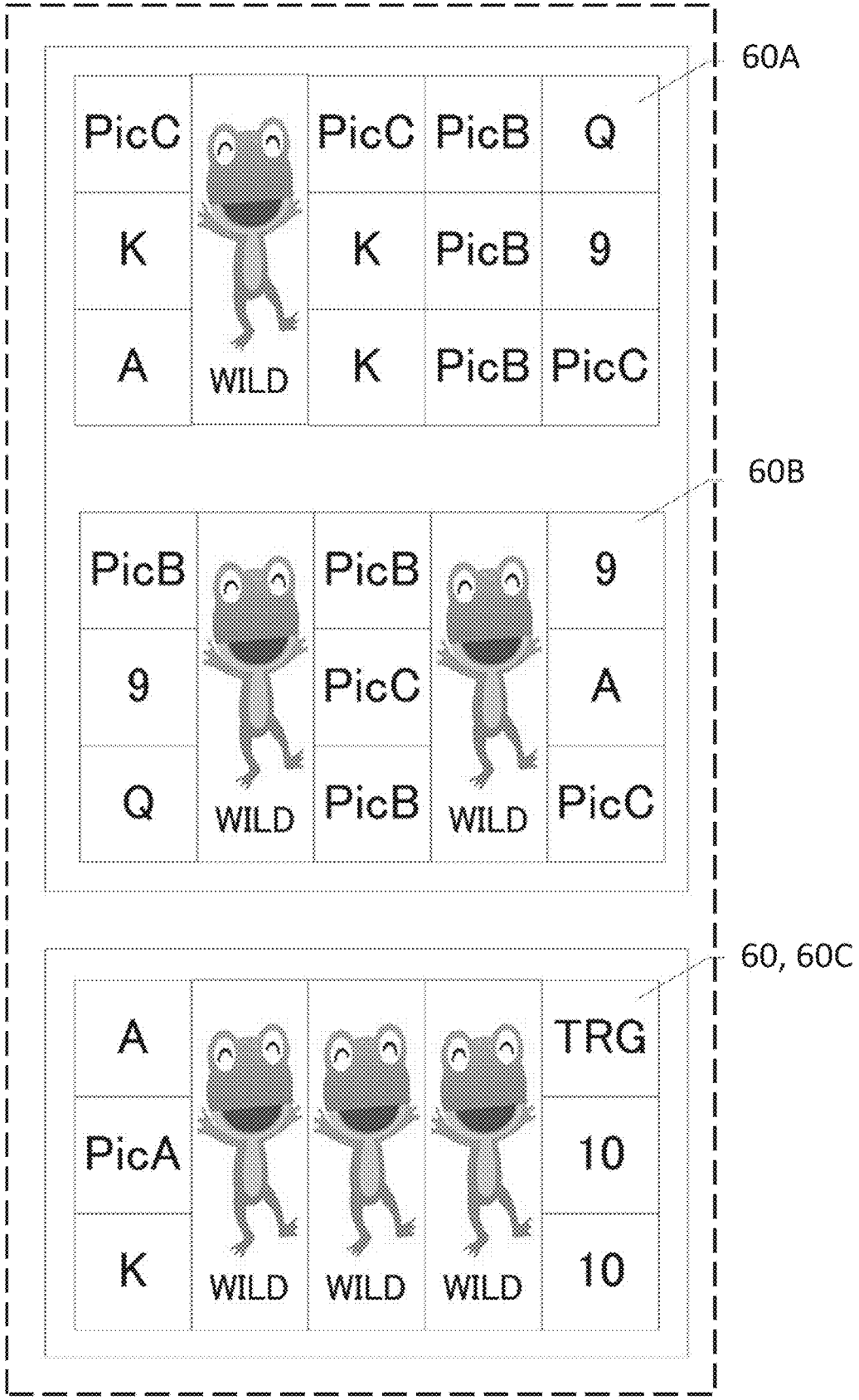
FIG. 20 is a twelfth diagrammatic illustration of the feature display areas of the gaming machine in FIG. 1 during a feature game, according to an embodiment of the present invention.

As shown in FIG. 20, the remaining reels in the third display area 60C are stopped. The symbols displayed in the third display area (including the instances of the predetermined symbol copied from the second display area 60B) form the third feature outcome. The third feature outcome may be evaluated once the reels associated with the third feature display area 60C have stopped, or may be evaluated with the first and second feature outcomes.

Figure 21:
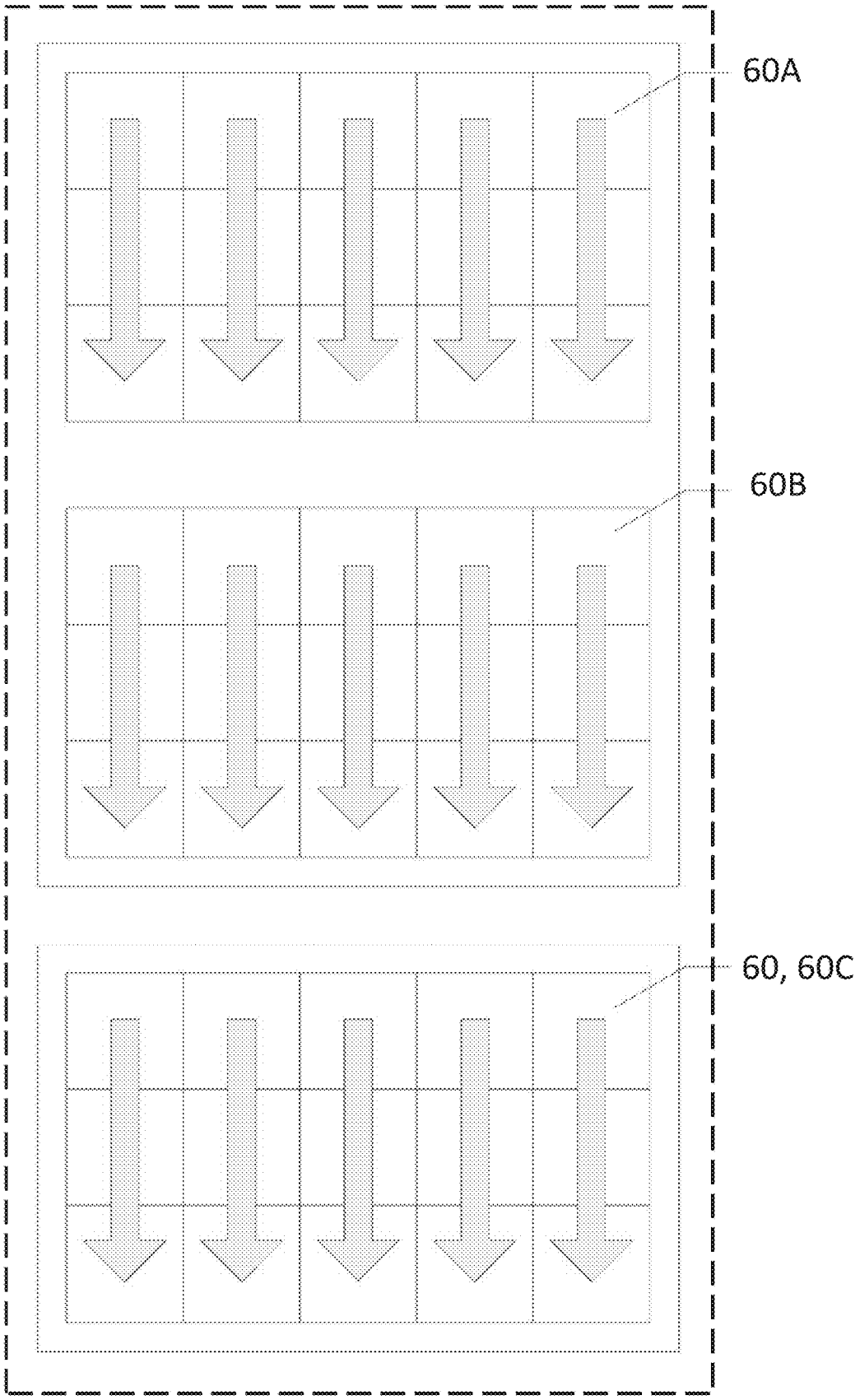
FIG. 21 is a thirteenth diagrammatic illustration of the feature display areas of the gaming machine in FIG. 1 during a feature game, according to an embodiment of the present invention.

Once all three outcomes have been evaluated, if there are any remaining free games of the feature game, the reels of all three feature display areas 60A, 60B, 60C are set to spinning (see FIG. 21).

Figure 22:
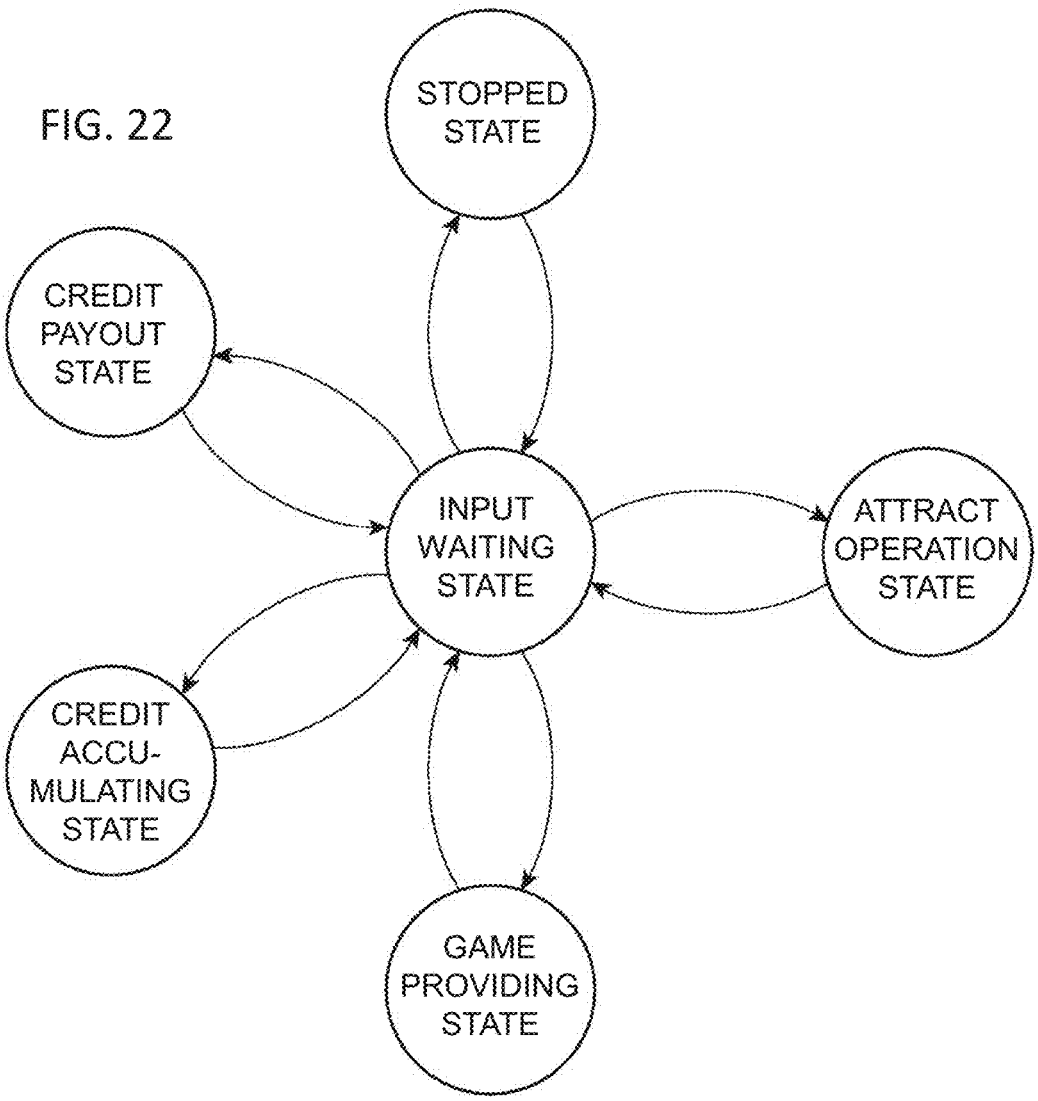
FIG. 22 is a state transition diagram for the gaming machine in FIG. 1.

Next, the operation of the gaming machine 1 according to the present embodiment is described referencing FIG. 22. FIG. 22 shows a state transition diagram of the gaming machine 1, according to the present embodiment configured above. As shown in FIG. 22, the gaming machine 1 takes each state of a game providing states, including a stopped state, an input waiting state, a credit payout state, a credit accumulation state and an attract operation state. Each state is described below.

The stopped state is a state where the gaming machine 1 is not started. The gaming machine 1 in the stopped state starts and is initialized when a predetermined start operation is received, a predetermined program is executed by the control unit 50, and the game screen is displayed on the lower display 26, which became the input waiting state.

When the bill/ticket identification unit 55 identifies a bill or credit, the gaming machine 1 in the input waiting state switches to a credit accumulation state, accumulating information of the corresponding credit inside of the gaming machine 1, and when the accumulation of credits ends, returns to the input waiting state. Further, when the operation of the payout button is received in a state where the information of credits is accumulated, the gaming machine 1 in the input waiting state switches to a credit payout state carrying out payout processing of the accumulated credit, and along with outputting a ticket with printed information corresponding to the credit payout processing from the printer unit 56, the credits accumulated in the gaming machine 1 returns to zero. The gaming machine 1 returns to the input waiting state when these processes have finished.

When not operated for a predetermined time, the gaming machine 1 in the input waiting state switches to the attract operation state that displays an attract screen on the upper display 21 and the lower display 26. The gaming machine 1 in an attract operation state returns to the input waiting state when receiving some operation. Further, an attract screen is a screen that appeals the existence of the gaming machine 1 to the customer, and is composed of a predetermined image and/or a video.

The gaming machine 1 in the input waiting state sets the bet number and the line number of the game by receiving an operation from the max bet button, the bet number selection button, or the line selection button when a credit is in an accumulated state inside, and by receiving the operation of a start button is switched to the game providing state, along with reducing the credit amount by only the set line number times the credit amount. In the game providing state, a game is provided according to the flowcharts shown in FIG. 23 and FIG. 24. The game providing state may be switched according to an operation by the bet number selection button or the max bet button.

In another aspect of the present invention, a control method for a gaming machine 1 to provide a game to a player is provided. The gaming machine 1 includes a control unit 10, an operation unit 44 and a display unit 27. The operation unit 44 is configured to receive operation from the player. The display unit 27 is operably coupled to the operation unit 44 and is configured to display a plurality of cells 64. The plurality of cells 64 are arranged in a plurality of rows and columns. The control unit 50 is operably coupled to the operation unit 44 and the display unit 27, and provides a primary game and a feature game. For each instance of the primary game, the control unit 50 is configured to randomly establish a symbol to be displayed within each of the plurality of cells of the primary display area 60. If a trigger condition is detected, then a feature game is initiated. The method includes the steps of randomly establishing a first set of symbols associated with the first feature symbol display area and displaying the established first set of symbols for the first feature symbol display area. The set of symbols displayed in the cells of the first feature symbol display area form a first feature outcome. The method also includes the steps of determining if a first instance of a predetermined symbol appears in the first feature outcome, randomly establishing a second set of symbols associated with the second feature display area, and copying the first instance of the predetermined symbol from the first feature symbol display area to the second feature symbol display area. The method further includes the step of displaying at least a part of the second set of symbols in the second feature display area. The at least a part of the set of second set of symbols and the first instance of the predetermined symbol form a second feature outcome. The method includes the steps of determining if a second instance of the predetermined symbol appears in the second feature outcome, randomly establishing a third set of symbols associated with the third feature display area, copying the first and second instances of the predetermined symbols from the second feature symbol display area to the third feature symbol display area, and displaying at least a part of the set of third set of symbols in the third feature display area. The at least a part of the set of third set of symbols and the first and second instances of the predetermined symbol form a third feature outcome.

Figure 23:
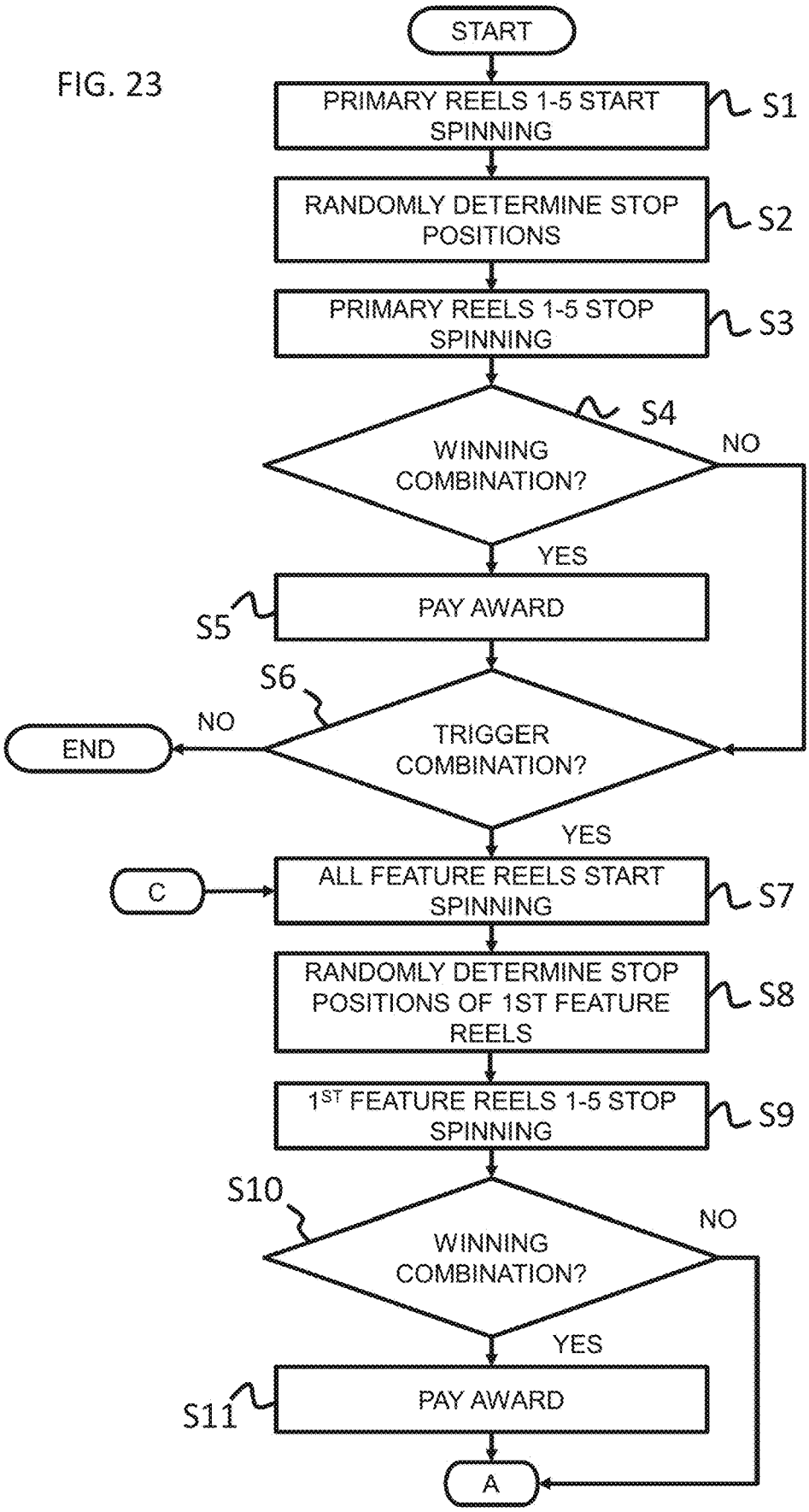
FIG. 23 is a first flow chart describing the operation of the gaming machine in FIG. 1, according to one embodiment of the present invention.
Figure 24:
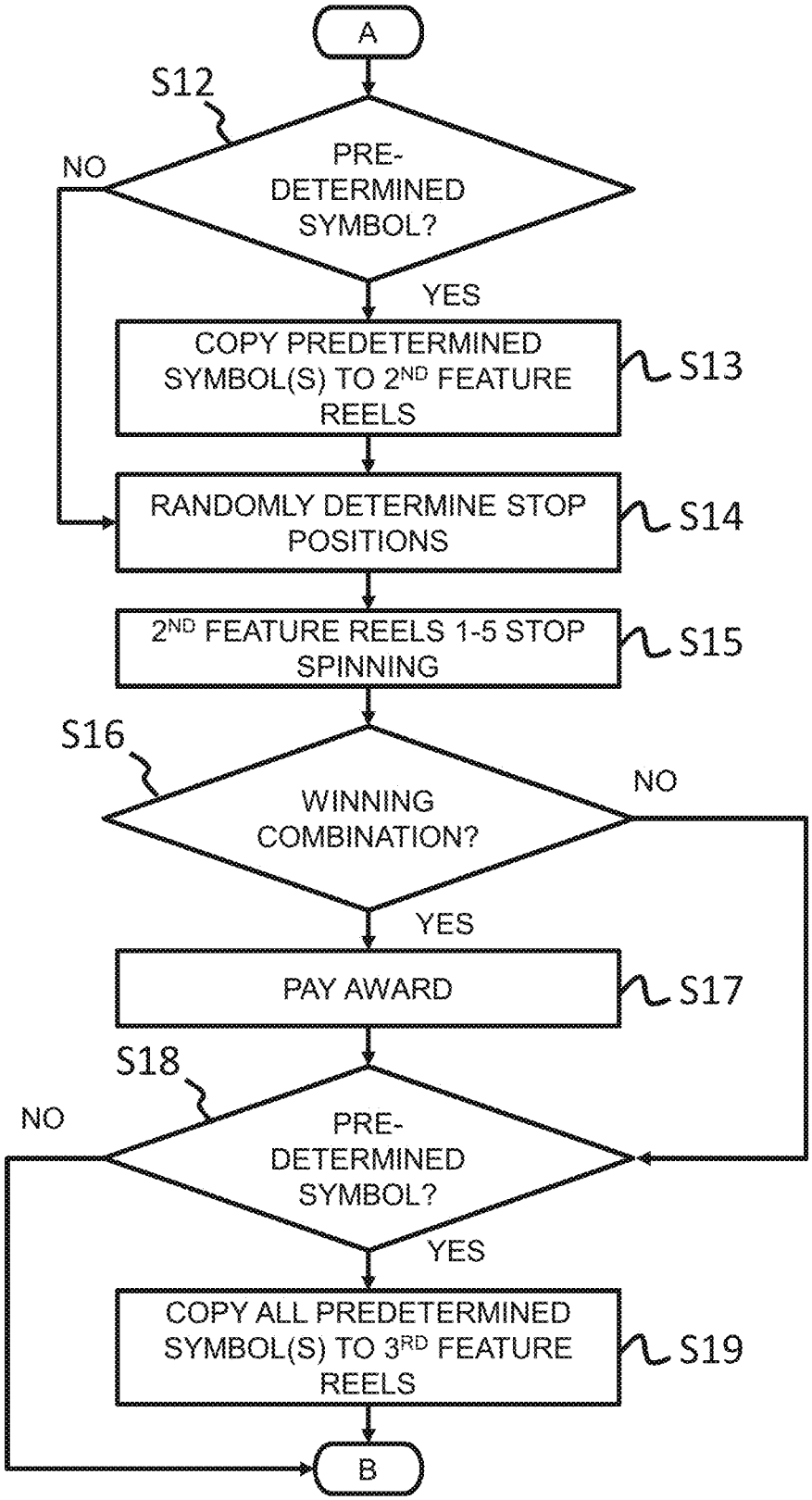
FIG. 24 is a second flow chart describing the operation of the gaming machine in FIG. 1, according to one embodiment of the present invention.
Figure 25:
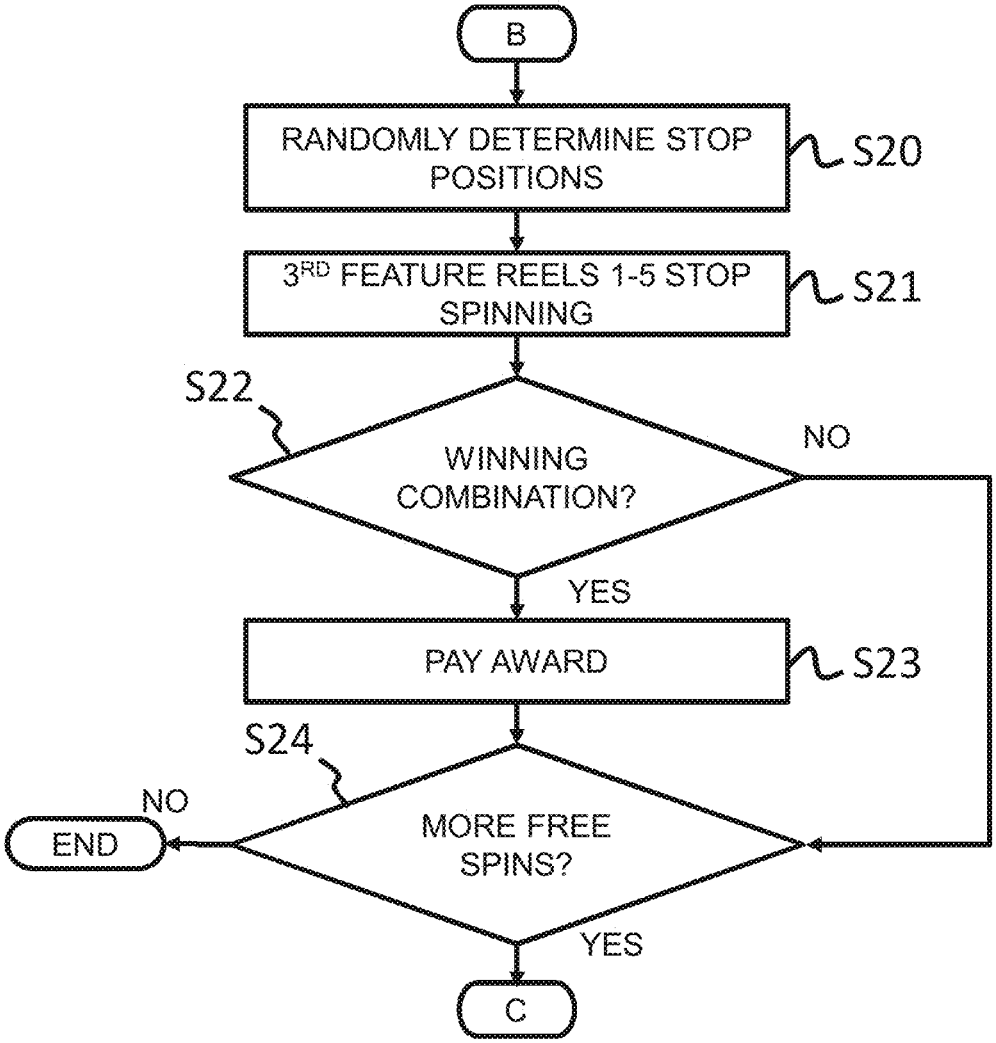
FIG. 25 is a third flow chart describing the operation of the gaming machine in FIG. 1, according to one embodiment of the present invention.
Figure 26:
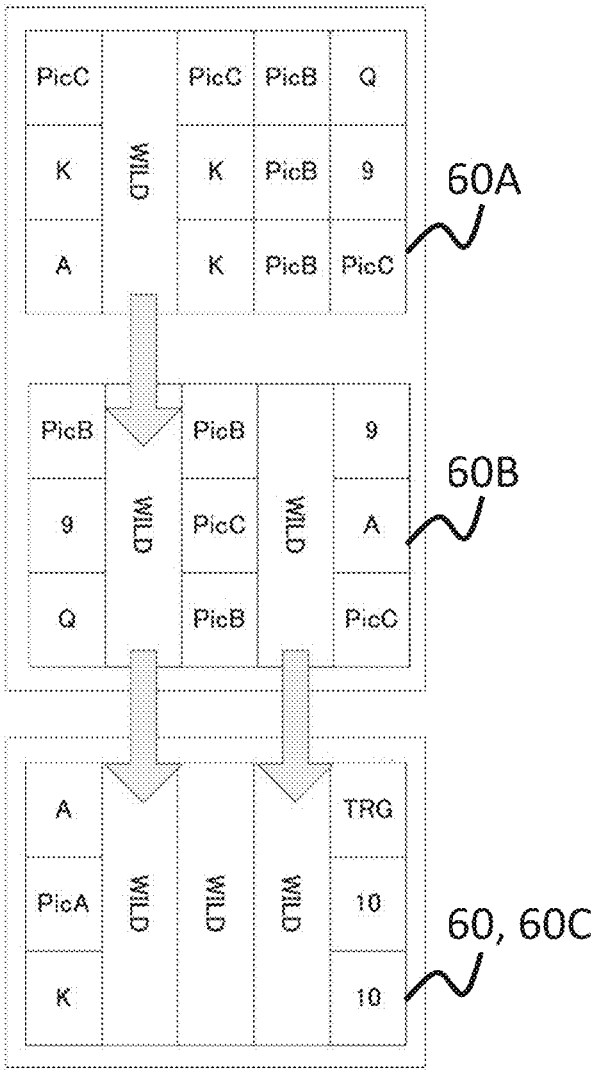
FIG. 26 is an exemplary diagrammatic illustration of a first, second and third feature display area during operation of the present invention.

With reference to FIGS. 23, 24 and 25 an exemplary flow diagram of a method for operating the gaming machine 1 is shown.

Initially, a main or primary game is played. In a first step S1, reels 1-5 are spun. In a second step S2, a stop position for each reel is randomly determined. In a third step S3, the reels are stopped. The symbols displayed in the determination area or grid 64 form an outcome. The outcome is compared with a predetermined pay table and (played) pay lines. If the outcome forms a winning outcome or combination (S4), then in a fifth step S5, an award is paid to the player (S5). If the outcome is not a winning combination, then the method proceeds to S6. As discussed above, a feature game is initiated if a trigger condition has occurred. In this embodiment, the trigger condition is the appearance of a predetermined number of trigger ("trig") symbols in the outcome of the main game.

If the trigger combination has not occurred (S6), then the main game ends. If the trigger combination appears in the main game, then the method proceeds to a seventh step S7 (signifying the start of the feature game). In the seventh step S7, the first and second display areas 60A, 60B are undimmed (and unlocked) and the reels of all three display areas 60A, 60B, 60C are set to spinning. In an eighth step S8, a stop position for each of the reels of the first feature display area 60A is determined, and in the ninth step S9, the reels of the first feature display area are stopped.

The displayed symbols form a first feature outcome. If the first feature outcome is a winning combination (in step S10), then an award is awarded to the player (step S11).

If an instance of the predetermined symbol appears in the first outcome (S12), then the instance(s) of the predetermined symbol is copied into the second display area 60B (step S13). In a fourteenth step S14, stop positions for the reels of the second display area 60B are randomly determined. In a fifteenth step S15, the reels of the second display area 60B are stopped.

Any copied instances of the predetermined symbol and the other displayed symbols form a second feature outcome. If the second feature outcome is a winning combination (S16), then an award is awarded to the player (S17).

If an instance of the predetermined symbol appears in the second outcome (including any instance copied from the first display area 60A), step S18, then it is copied into the $3^{rd}$ feature reels of the third display area 60C (S19).

Turning to FIG. 25, in a twentieth step S20, stop positions for the reels of the third feature display area 60C are randomly determined. In a twenty-first step S21, the reels of the third feature display area 60C are stopped. Any instance of the predetermined symbol copied from the second display area 60B and the other displayed symbols form the third feature outcome. In S22, if the third feature outcome forms a winning combination, then an award is awarded in a twenty-third step S23.

If in step S24, there are more free spins available, then the control method returns to the seventh step S7. Otherwise, the control method ends.

Next is a description of a program of the gaming machine 1 for operating one or a plurality of computers as the control unit 50. The gaming machine 1 stores the program in the memory, and can execute the program. The gaming machine 1 can access the program stored in the memory and can operate as the gaming machine 1 of the present embodiment by the program.

Further, the program according to the embodiment, may be provided through a network or stored in a recording medium. Recording media such as a floppy (registered trademark) disk, CD-ROM, DVD, or ROM and the like, or semiconductor memory and the like are exemplified as recording mediums. In this case, a program stored in the memory uses a reading device inside the gaming machine 1 such as a floppy (registered trademark) disk drive device, CD-ROM drive device, and DVD drive device and the like.

The embodiments of the present invention are described above, but the present invention is not limited to such an embodiment; a variety of variations are possible.

In such an embodiment, a gaming machine providing a game in the form of a slot machine is described, but this is not limited thereto, and a game in the state of poker, a video card game called black jack, bingo, keno, a wheel game and the like may be provided. Further, it is possible to apply the present invention to a pachinko machine or a pachinko slot machine.

Referring to FIG. 1, in one embodiment, the control panel 41 includes a plurality of user input devices that may include an acceptor device which accepts media associated with a monetary value to establish a credit balance, a validator configured to identify the physical media and a cash-out button actuatable to cause an initiation of a payout associated with the credit balance. The acceptor device may include a touchscreen display associated with the display unit 27 and/or the player tracking unit 57, the bill/ticket identification unit 42, the operation unit 44, the player tracking unit 57, a coin slot, a ticket in/ticket out (TITO) system, a bill acceptor, and/or any suitable device that enables the gaming machine 1 to receive media associated with a monetary value and establish a credit balance for use in playing the gaming machine. In one embodiment, the acceptor device may be configured to receive physical media such as, for example, a coin, a medal, a ticket, a card, a bill, currency, and/or any suitable physical media that enables the gaming machine 1 to function as described herein. The acceptor device may also be configured to accept virtual media such as, for example, a player tracking account, a virtual credit balance, reward points, gaming credits, bonus points, and/or any suitable virtual media that enables the gaming machine 1 to function as described herein. For example, in one embodiment, the coin slot may include an opening that is configured to receive coins and/or tokens deposited by the player into the gaming machine 1. The control unit 50 converts a value of the coins and/or tokens to a corresponding amount of gaming credits that are used by the player to wager on games played on the gaming machine 1. The bill acceptor may include an input and output device that is configured to accept a bill, a ticket, and/or a cash card into the bill acceptor to enable an amount of gaming credits associated with a monetary value of the bills, ticket, and/or cash card to be credited to the gaming machine 1. In one embodiment, the bill acceptor also includes a printer (not shown) that is configured to dispense a printed voucher ticket that includes information indicative of an amount of credits and/or money paid out to the player by the gaming machine 1 during a gaming session. The voucher ticket may be used at other gaming devices, or redeemed for cash, and/or other items as part of a casino cashless system.

In the embodiment, determining the stop position of each reel is described as consecutively acquiring a random number that is used respectively, but the acquisition procedure of the random number is not limited to this. For example, when the game starts, the control unit 50 acquires these random numbers in a batch, and each random number may be stored in the storage area of the non-erasing memory 53 or the storage 54 when power failure occurs. In this type of situation, even when a power failure and the like occur during a game, because the control unit 50 acquired the random number from the memory 53 or the storage 54 when the game started before the power failure occurred, when resuming the game after recovering from a power failure, the progress of the game can be reproduced. For example, when a game result obtaining a high payout is formed right before a power failure occurs, the player will be greatly dissatisfied if the progress of the game is not similar after recovering from a power failure. However, as mentioned above, when the game starts, all of the random numbers are acquired in a batch, and by saving these random numbers in the memory 53 or the storage 54, such great dissatisfaction can be avoided for the player because the progress of a game similar to before a power failure occurred can be reproduced after recovering from a power failure.

Further, in the embodiment, a bill or ticket is displayed as game value, and received by these bill/ticket identification devices, and a form where a ticket is output by a printer unit is described, but the present invention is not limited to this. The game value is a concept, including tangible objects such as a coin, bill, coin, medal, ticket, and the like, or electronic data that has a value equivalent to these. For example, a coin is received by the coin acceptor, and there may be a form where a coin is paid by a coin hopper. A player is identified, and credit that is accumulated in an account on a server is used; there may be a form where credit is paid to an account, information of credit stored in a storage medium of a magnetic card, IC card and the like is read and used, and there may be a form where credit is paid by writing to the storage medium.

Further, in the embodiment, when showing a free game provided as a bonus game, a bonus game that uses a different virtual reel strip from a regular game may be provided. Further, there could be provided a feature game according to a value of the random number acquired during a regular game.

Further, set conditions providing a bonus or feature game are not limited to trigger determination or line determination, for example, there may be a configuration providing a bonus game when the bet number surpasses a predetermined value. There could be a configuration providing a bonus game according to a value of the random number acquired during a regular game.

Further, in the embodiment, a form providing a free game for a predetermined number of times as a bonus game is shown, and a bonus game that is not limited to a number of times may be provided. In this situation, there could be a configuration providing a bonus game until an end condition is satisfied, as an end condition is a combination of specified symbols, or a determining bonus game based on a random number.

Exemplary embodiments of a gaming device, a gaming system and a method of providing an award to a player are described above in detail. The gaming device, system and method are not limited to the specific embodiments described herein, but rather, components of the gaming device and/or system and/or steps of the method may be utilized independently and separately from other components and/or steps described herein. For example, the gaming device may also be used in combination with other gaming systems and methods, and is not limited to practice with only the gaming device as described herein. Rather, an exemplary embodiment can be implemented and utilized in connection with many other gaming system applications. For instance, the present invention is applicable to a gaming system which is a combination of a community gaming system and individual gaming devices. In such a case, the individual gaming device and the community gaming device provide feature game cooperatively by providing 1st and 2nd feature display area on the community gaming system and 3rd feature display area on the individual gaming devices et al. And the predetermined symbol is copied from the 1st and 2nd feature display area on the community gaming system to 3rd feature display area on the individual gaming devices and the like.

A controller, computing device, or computer, such as described herein, includes at least one or more processors or processing units and a system memory. The controller typically also includes at least some form of computer-readable media. By way of example and not limitation, computer-readable media may include computer storage media and communication media. Computer storage media may include volatile and non-volatile, removable and non-removable media implemented in any method or technology that enables storage of information, such as computer-readable instructions, data structures, program modules or other data. Communication media typically embody computer-readable instructions, data structures, program modules or other data in a modulated data signal, such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer-readable media.

The order of execution or performance of the operations in the embodiments of the invention illustrated and described herein is not essential, unless otherwise specified. That is, the operations described herein may be performed in any order, unless otherwise specified, and embodiments of the invention may include additional or fewer operations than those disclosed herein. For example, it is contemplated that executing or performing a particular operation before, contemporaneously with, or after another operation is within the scope of aspects of the invention.

In some embodiments, a processor, as described herein, includes any programmable system including systems and microcontrollers, reduced instruction set circuits (RISC), application specific integrated circuits (ASIC), programmable logic circuits (PLC) and any other circuit or processor capable of executing the functions described herein. The above examples are exemplary only, and thus are not intended to limit in any way the definition and/or meaning of the term "processor".

In some embodiments, a database, as described herein, includes any collection of data including hierarchical databases, relational databases, flat file databases, object-relational databases, object oriented databases and any other structured collection of records or data that is stored in a computer system. The above examples are exemplary only, and thus are not intended to limit in any way the definition and/or meaning of the term "database". Examples of databases include, but are not limited to only including, Oracle® Database, MySQL, IBM® DB2, Microsoft® SQL Server, Sybase®, and PostgreSQL. However, any database may be used that enables the systems and methods described herein. (Oracle is a registered trademark of Oracle Corporation, Redwood Shores, Calif.; IBM is a registered trademark of International Business Machines Corporation, Armonk, N.Y.; Microsoft is a registered trademark of Microsoft Corporation, Redmond, Wash.; and Sybase is a registered trademark of Sybase, Dublin, Calif.)

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Other aspects and features of the present invention can be obtained from a study of the drawings, the disclosure and the appended claims. The invention may be practiced other than as specifically described within the scope of the appended claims. It should also be noted that the steps and/or functions listed within the appended claims, notwithstanding the order of which steps and/or functions are listed therein, are not limited to any specific order of operation.

Although specific features of various embodiments of the invention may be shown in some drawings and not in others, this is for convenience only. In accordance with the principles of the invention, any feature of a drawing may be referenced and/or claimed in combination with any feature of any other drawing.

What is claimed is:

1. A gaming machine for providing a game to a player, comprising:

a display unit operably configured to display a first symbol display area and a second symbol display area, each display area includes a plurality of cells arranged in a grid, wherein each grid includes a plurality of columns and a plurality of rows, each column has an associated virtual reel, wherein the first symbol display area includes a first plurality of virtual reels and the second symbol display area includes a second plurality of virtual reels; and, a control unit operably coupled to the display unit, and being configured to provide an instance of the game to the player, the control unit, in response to initiation of the game, being further configured to:

rotate the first plurality of virtual reels and the second plurality of virtual reels;

randomly establish a first set of symbols associated with the first symbol display area;

stop the first plurality of virtual reels to display the established first set of symbols, forming a first outcome;

determine if a first instance of a predetermined symbol appears in the first outcome;

randomly establish a second set of symbols associated with the second symbol display area;

animate a copy of the first instance of the predetermined symbol from the first symbol display area to a corresponding column in the second symbol display area with the second plurality of virtual reels rotating; and, stop the second plurality of virtual reels to display at least a part of the second set of symbols in the second symbol display area, forming a second outcome.

2. A gaming machine, as set forth in claim 1, wherein the display unit is operably configured to display a third symbol display area, the first symbol display area, the second symbol display area, and the third symbol display area are oriented vertically such that the second symbol display area is between the first symbol display area and the symbol display area, the third symbol display area including a plurality of cells arranged in a grid, the grid of the third symbol display area including a plurality of columns and a plurality of rows, each column of the third symbol display area having an associated virtual reel, the control unit being further configured to:

determine if a second instance of the predetermined symbol appears in the second outcome;

randomly establish a third set of symbols associated with the third symbol display area;

animate another copy of the first instance and a copy of the second instance of the predetermined symbol from the second symbol display area to corresponding columns in the third symbol display area with the third plurality of virtual reels rotating; and stop the third plurality of virtual reels to display at least a part of the set of third set of symbols in the third symbol display area, the at least a part of the set of third set of symbols and the another copy of the first instance and the copy of the second instance of the predetermined symbol forming a third outcome.

3. A gaming machine, as set forth in claim 1, wherein the game is provided as a feature to a primary game and the control unit provides an instance of the primary game utilizing one of the symbol display areas.

4. A gaming machine, as set forth in claim 3, wherein the control unit, in providing the primary game, is configured to randomly establish a primary set of symbols associated with the primary game and to display the primary set of symbols within the plurality of cells of the one of the symbol display areas, wherein the displayed primary set of symbols form a primary outcome.

5. A gaming machine, as set forth in claim 4, wherein the control unit is configured to provide the game in response to detecting a feature trigger condition during an instance of the primary game and wherein the feature trigger condition is the appearance of a predetermined number of trigger symbols within the primary outcome.

6. A gaming machine, as set forth in claim 4, wherein the control unit is configured to award the player a primary award as a function of the primary outcome.

7. A gaming machine, as set forth in claim 1, wherein the control unit is configured to award the player an award as a function of at least one of the first and second outcomes.

8. A gaming machine, as set forth in claim 1, wherein the control unit is further configured to animate the copy of the first instance of the predetermined symbol by simulating a vertical movement of the first instance of the predetermined symbol from the first feature symbol display area to the second feature symbol display area.

9. A gaming machine, as set forth in claim 1, wherein the control unit is further configured to display the first instance of the predetermined symbol in the first feature symbol display area after the step of animating the copy of the first instance of the predetermined symbol from the first feature symbol display area to the corresponding column in the second feature symbol display area.

10. A gaming machine, as set forth in claim 1, wherein each column includes a plurality of cells, wherein the predetermined symbol is an enlarged stack symbol that spans a number of cells.

11. A gaming machine, as set forth in claim 10, wherein an instance of the predetermined symbol appears in an outcome if the predetermined symbol covers all of the cells in a single column.

12. A gaming machine as set forth in claim 10, wherein the enlarged stack symbol is an enlarged wild symbol.

13. A control method for providing a game to a player using a gaming machine, the gaming machine including a control unit and a display unit, the control unit being operably coupled to the display unit, the method including the steps of:

displaying, on the display unit, a first symbol display area and a second symbol display area, each display area includes a plurality of cells arranged in a grid, wherein each grid includes a plurality of columns and a plurality of rows, each column has an associated virtual reel, wherein the first symbol display area includes a first plurality of virtual reels and the second symbol display area includes a second plurality of virtual reels; and, providing, by the control unit, an instance of the game, the control unit in providing the instance of the game, provides the steps of:

rotating the first plurality of virtual reels and the second plurality of virtual reels;

randomly establishing a first set of symbols associated with the first symbol display area;

stopping the first plurality of virtual reels to display the established first set of symbols, forming a first outcome;

determining if a first instance of a predetermined symbol appears in the first outcome;

randomly establishing a second set of symbols associated with the second symbol display area;

animating a copy of the first instance of the predetermined symbol from the first symbol display area to a corresponding column in the second symbol display area with the second plurality of virtual reels rotating; and, stopping the second plurality of virtual reels to display at least a part of the second set of symbols in the second symbol display area, forming a second outcome.

14. A control method, as set forth in claim 13, wherein the display unit is operably configured to display a third symbol display area, the first symbol display area, the second symbol display area, and the third symbol display area are oriented vertically such that the second symbol display area is between the first symbol display area and the symbol display area, the third symbol display area including a plurality of cells arranged in a grid, the grid of the third symbol display area including a plurality of columns and a plurality of rows, each column of the third symbol display area having an associated virtual reel, the control unit being further to perform the steps of:

determining if a second instance of the predetermined symbol appears in the second outcome;

randomly establishing a third set of symbols associated with the third symbol display area;

animating another copy of the first instance and a copy of the second instance of the predetermined symbol from the second symbol display area to corresponding columns in the third symbol display area with the third plurality of virtual reels rotating; and stopping the third plurality of virtual reels to display at least a part of the set of third set of symbols in the third symbol display area, the at least a part of the set of third set of symbols and the another copy of the first instance and the copy of the second instance of the predetermined symbol forming a third outcome.

15. A control method, as set forth in claim 13, wherein the game is provided as a feature to a primary game and the control unit provides an instance of the primary game utilizing one of the symbol display areas.

16. A control method, as set forth in claim 15, wherein the control unit, in providing the primary game, is configured to perform the steps of:

randomly establishing a primary set of symbols associated with the primary game, and displaying the primary set of symbols within the plurality of cells of the one of the symbol display areas, wherein the displayed primary set of symbols form a primary outcome.

17. A control method, as set forth in claim 16, wherein the control unit is configured to provide the game in response to detecting a feature trigger condition during an instance of the primary game and wherein the feature trigger condition is the appearance of a predetermined number of trigger symbols within the primary outcome.

18. A control method, as set forth in claim 16, wherein the control unit performs the step of awarding the player a primary award as a function of the primary outcome.

19. A control method, as set forth in claim 13, wherein the control unit performs the step of awarding award as a function of at least one of the first and second outcomes.

20. A control method, as set forth in claim 13, wherein the control unit is further configured to animate the copy of the first instance of the predetermined symbol by simulating a vertical movement of the first instance of the predetermined symbol from the first feature symbol display area to the second feature symbol display area.

21. A control method, as set forth in claim 13, wherein the control unit is further configured to display the first instance of the predetermined symbol in the first feature symbol display area after the step of animating the copy of the first instance of the predetermined symbol from the first feature symbol display area to the corresponding column in the second feature symbol display area.

22. A control method, as set forth in claim 13, wherein each column includes a plurality of cells, wherein the predetermined symbol is an enlarged stack symbol that spans a number of cells.

23. A control method, as set forth in claim 22, wherein an instance of the predetermined symbol appears in an outcome if the predetermined symbol covers all of the cells in a single column.

24. A control method, as set forth in claim 22, wherein the enlarged stack symbol is an enlarged wild symbol.

* * * * *